US011858722B2

(12) United States Patent
Tchira et al.

(10) Patent No.: US 11,858,722 B2
(45) Date of Patent: Jan. 2, 2024

(54) FLORAL WRAPPER

(71) Applicant: Hammerhead Group, LLC, Doral, FL (US)

(72) Inventors: Steven Tchira, Doral, FL (US); Gilda Yvette Speziani, Doral, FL (US); Bibiana Pulido, Doral, FL (US); Nara Almeida, Doral, FL (US)

(73) Assignee: Hammerhead Group, LLC, Doral, FL (US)

( * ) Notice: Subject to any disclaimer, the term of this patent is extended or adjusted under 35 U.S.C. 154(b) by 544 days.

(21) Appl. No.: 16/683,964

(22) Filed: Nov. 14, 2019

(65) Prior Publication Data

US 2020/0290796 A1 Sep. 17, 2020

Related U.S. Application Data

(63) Continuation-in-part of application No. 29/683,786, filed on Mar. 15, 2019, now Pat. No. Des. 911,854.

(51) Int. Cl.
*B65D 85/50* (2006.01)
*B65D 65/08* (2006.01)
(Continued)

(52) U.S. Cl.
CPC ..... *B65D 85/505* (2013.01); *B65D 65/06* (2013.01); *B65D 65/08* (2013.01); *B65D 65/12* (2013.01)

(58) Field of Classification Search
CPC ..... B65D 65/10; B65D 85/50; B65D 65/12; B65D 65/08; B65D 65/06; B65D 85/505; B65D 85/52; B65D 65/14; B65D 65/22
(Continued)

(56) References Cited

U.S. PATENT DOCUMENTS 1,893,523 A 1/1933 Radzinsky
2,350,222 A 6/1942 Fichman
(Continued)

FOREIGN PATENT DOCUMENTS

EP 1535852 A1 * 6/2005 ..... B65D 31/18
FR 2988378 B1 5/2015
(Continued)

OTHER PUBLICATIONS

Double Sides Flower Wrapping Paper Two Layers Florist Bouquet Packaging Supplies 22*18 Inch Wrapping Paper Supplies Wrapping P . . . , DHGate.com, 5 pages, printed Mar. 27, 2019.
(Continued)

*Primary Examiner* — Anthony D Stashick
*Assistant Examiner* — L Kmet
(74) *Attorney, Agent, or Firm* — Fleit Intellectual Property Law; Paul D. Bianco; Gary S. Winer

(57) ABSTRACT

Various floral wrapper systems to hold plant/floral arrangements are provided. In one version, the floral wrapper includes a protective outer sheet; and a decorative inner sheet affixed to the inner surface of the protective outer sheet. The protective outer sheet can be folded about the decorative inner sheet to form a pocket for supporting a floral arrangement therein. In another version, the floral wrapper includes a first sheet with a portion removed to form a side and a second sheet with a portion removed to form a side. The first and second sheets are affixed to each other with the first and second sheets partially overlapping each other and with the formed side of the first sheet and the formed side of the second sheet aligned along a line. Additional sheets can be added to modify the structure and ornamental appearance of the floral wrapper.

20 Claims, 21 Drawing Sheets

(51) Int. Cl.
*B65D 65/12* (2006.01)
*B65D 65/06* (2006.01)

(58) Field of Classification Search
USPC ..... 206/423
See application file for complete search history.

(56) References Cited

U.S. PATENT DOCUMENTS

| | | | |
|---|---|---|---|
| 3,514,355 | A | 5/1970 | Welin-Berger |
| 3,861,974 | A | 1/1975 | Trombly |
| 5,011,707 | A | 4/1991 | Schell |
| 5,443,670 | A | 8/1995 | Landau |
| D398,224 | S | 9/1998 | Weder et al. |
| D407,305 | S | 3/1999 | Weder et al. |
| 5,890,592 | A | 4/1999 | Weder |
| 6,023,790 | A | 2/2000 | Schwartz |
| D436,312 | S | 1/2001 | Denbraver |
| 6,183,590 | B1 | 2/2001 | Weder |
| 6,195,962 | B1 | 3/2001 | Weder |
| 6,406,651 | B1 | 6/2002 | Weder |
| 6,719,679 | B1 | 4/2004 | Lin |
| 7,332,052 | B2 | 2/2008 | Colgan |
| 7,396,320 | B2 | 7/2008 | Tchira |
| 7,540,113 | B2 | 6/2009 | Gilbert |
| 8,490,329 | B2 | 7/2013 | Weder |
| D697,819 | S | 1/2014 | Saville et al. |
| D864,750 | S | 10/2019 | Jordan |
| D876,240 | S | 2/2020 | Eijkenaar |
| D911,854 | S | 3/2021 | Tchira |
| D972,941 | S | 12/2022 | Tchira |
| 2004/0121130 | A1 | 6/2004 | Weder |
| 2007/0051040 | A1* | 3/2007 | Weder ..... B65D 85/505 47/72 |
| 2009/0031671 | A1 | 2/2009 | Temkin |
| 2012/0043243 | A1 | 2/2012 | Selina |
| 2013/0068381 | A1 | 3/2013 | Tchira |
| 2019/0037776 | A1 | 2/2019 | Wiggers |

FOREIGN PATENT DOCUMENTS

| | | | |
|---|---|---|---|
| JP | 7017557 | | 1/1995 |
| NL | 1033166 | C | 5/2008 |
| NL | 1035902 | C | 3/2010 |
| WO | 2004/000669 | A1 | 12/2003 |
| WO | 2005/042378 | A1 | 5/2005 |
| WO | 2015/164539 | A2 | 10/2015 |

OTHER PUBLICATIONS

S. Walter Packaging, DIY Floral Bouquet Wrap, 6 pages, printed Mar. 37, 2019.

Examination Report for Canadian Patent App. No. 189649, dated Nov. 13, 2020.

Response for Canadian Patent App. No. 189649, filed Feb. 10, 2021.

Say Yes!, How to Wrap Bouquets of Fresh Flowers (And a Secret Freshness Trick!), https://sayyes.com/2015/03/how-to-wrap-a-bouquet-of-fresh-flowers-and-a-secret-freshness-trick, Mar. 17, 2015, 5 pages.

* cited by examiner

FLORAL WRAPPER

FIELD OF THE INVENTION

The present invention relates to wrapping material for wrapping plants and floral arrangements.

BACKGROUND OF THE INVENTION

Wrappings for plants and floral arrangements use one or more sheets of paper and/or films. These sheets usually take the form of square or rectangular sheets, which are folded about the plants/floral arrangements. Depending on the desired look, multiple sheets/films can be combined to provide an intricate decorative appearance. Typically, the more intricate the appearance, the more materials and folds are required. This can result in an increase in material and labor costs to complete. Additionally, the sheets generally lack guides or indications showing how to fold the sheets, making it difficult for both manufacturers and/or end-users to achieve a consistent finished product. Thus, there exists a need for an improved floral wrapper.

SUMMARY OF THE INVENTION

In an embodiment, a floral wrapper according to the disclosure comprises a protective outer sheet having a perimeter; and a decorative inner sheet affixed to the protective outer sheet, with the decorative inner sheet only covering an upper portion of the protective outer sheet. The protective outer sheet comprises a first outer section, a second outer section, and a center section interposed between the first outer section and the section outer section. The perimeter is defined by at least three sides of the first outer section, at least three sides of the center section, and at least three sides of the second outer section.

The floral wrapper can be affixed across the first outer section, the center section, and/or the second outer section. A bonding element can be used to affix the outer surface of the first outer section to the inner surface of the second outer section. In this regard, an outer surface of the first outer section can include a first bonding element and an inner surface of the second outer section can include a second bonding element so that the first bonding element and the second bonding element affix the outer surface of the first outer section to the inner surface of the second outer section.

An outer surface of the protective outer sheet can include a design to enhance the visual appearance of the floral wrapper. In order to facilitate the forming of the floral wrapper in some embodiments, a first folding guide separates the first outer section and the center section and a second folding guide separates the center section and the second outer section. The first outer section is foldable along the first folding guide to at least partially cover the center section and the second outer section is foldable along the second folding guide to at least partially cover the center section and the first outer section. The first and second folding guides can comprise visual indicia on the protective sheet. The first and second folding guides can each include a crease on the protective sheet.

A floral wrapper system according to the disclosure comprises a plurality of floral wrappers removable bounded together. In some embodiments, each of the plurality of floral wrappers comprises a header portion with each of the plurality of floral wrappers separable from a corresponding header portion.

In another embodiment, a floral wrapper according to the disclosure comprises a first sheet with a portion removed to form a side and a second sheet with a portion removed to form a side. The first and second sheets are affixed to each other with the first and second sheets partially overlapping each other and with the formed side of the first sheet and the formed side of the second sheet aligned along a line.

In some embodiments, the floral wrapper includes a third sheet with a portion removed to form a side. The third sheet is affixed to the first and second sheets so that the first, second, and third sheets partially overlap each other and with the formed side of the first sheet. The formed side of the second sheet and the formed side of the third sheet are aligned along a line.

In another embodiment, a floral wrapper according to the disclosure comprises: a first sheet having a substantially rectangular or square shape with a corner removed to create a first sheet fifth side; a second sheet having a substantially rectangular or square shape with a corner removed to create a second sheet fifth side; and a third sheet having a substantially rectangular or square shape with a corner removed to create a third sheet fifth side. The first, second, and third sheets are affixed to each other with the first, second, and third sheets partially overlapping each other and with the fifth side of the first sheet, the fifth side of the second sheet and the fifth side of the third sheet aligned along a straight line.

A raffia can be used for securing the floral wrapper wrapped around a floral arrangement.

In an exemplary embodiment, the first sheet is substantially square and each of the second and third sheets is substantially rectangular. The first, second, and third sheets are affixed to each other with the first sheet between the second and third sheets and with the second sheet positioned on the first sheet and the third sheet positioned on the second sheet. The second and third sheets can be mirror images of each other.

In another exemplary embodiment, each of the first and second sheets is substantially square, and the third sheet is substantially rectangular. The first, second, and third sheets are affixed to each other with the third sheet between the first and second sheets and with the second sheet positioned on the first sheet and the third sheet positioned on the second sheet.

In another exemplary embodiment, the floral wrapper further comprises a fourth sheet having a substantially rectangular or square shape with a corner removed to create a fourth sheet fifth side. The fourth sheet is affixed to at least one of the first, second, and third sheets with the fourth sheet partially overlapping each of the first, second, and third sheets and with the fifth side of the fourth sheet aligned along the straight line. Each of the first and second sheets can be substantially square and each of the third and fourth sheets can be substantially rectangular. The first, second, third, and fourth sheets are affixed to each other with the third and fourth sheets between the first and second sheets and with the second sheet positioned on the first sheet, the third sheet positioned on the second sheet, and the fourth sheet positioned on the third sheet.

In another exemplary embodiment, the floral wrapper further comprises a fifth sheet having a substantially rectangular or square shape with a corner removed to create a fifth sheet fifth side. The fifth sheet is affixed to at least one of the first, second, third, and fourth sheets with the fifth sheet partially overlapping each of the first, second, third, and fourth sheets and with the fifth side of the fifth sheet aligned along the straight line. The fifth sheet can be substantially rectangular. The fifth sheet is affixed to the first, second, third, and fourth sheets with the fifth sheet between the third and fourth sheets and with the fifth sheet positioned on the fourth sheet.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 2:
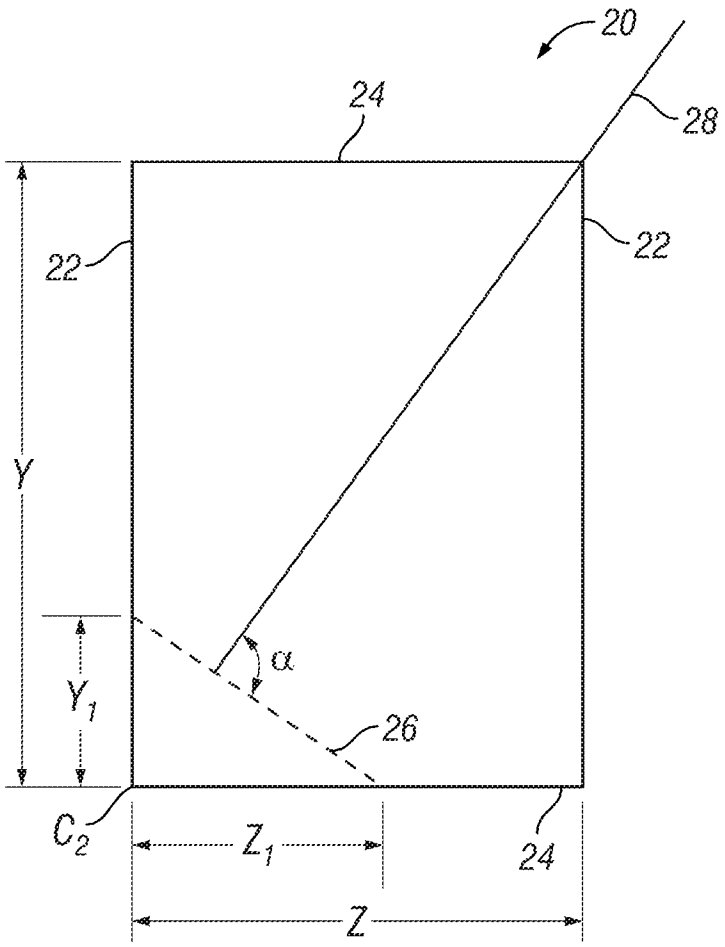
FIG. 2 depicts a second sheet of the three-sheet embodiment of a wrapping system of the present invention.
Figure 1:
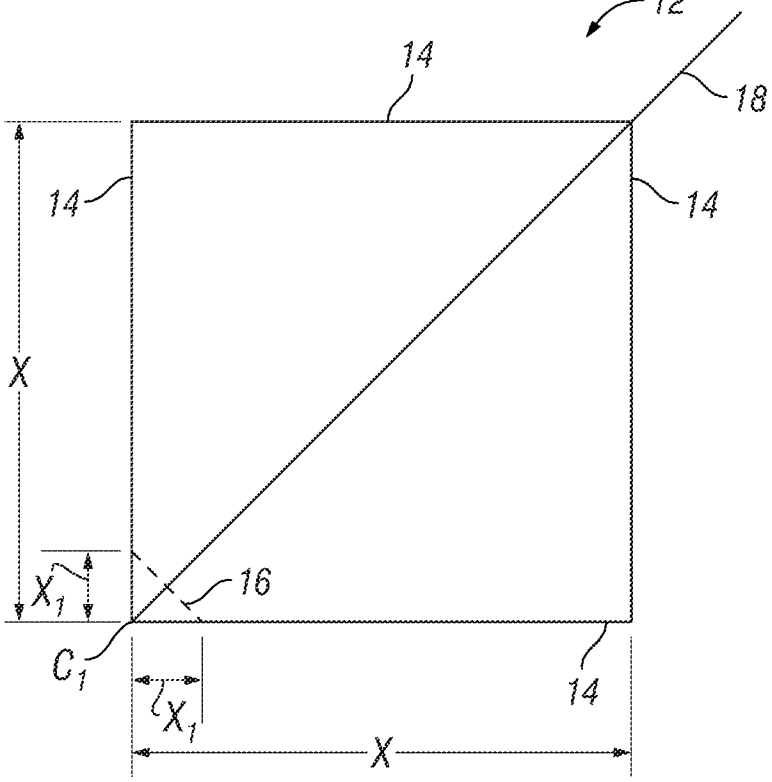
FIG. 1 depicts a first sheet of a three-sheet embodiment of a wrapping system of the present invention.
Figure 3:
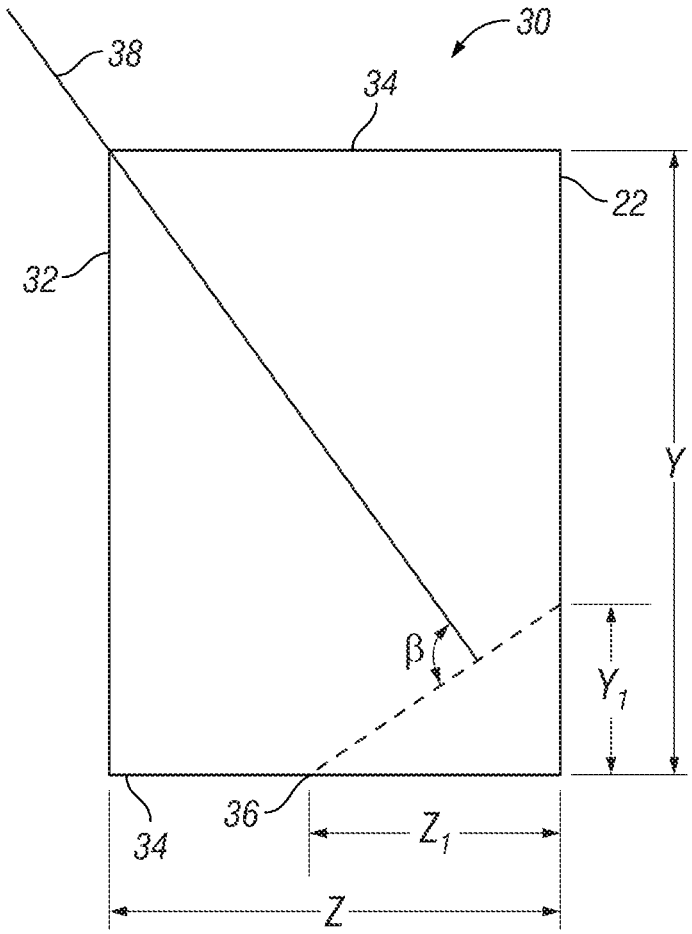
FIG. 3 depicts a third sheet of the three-sheet embodiment of a wrapping system of the present invention.
Figure 4:
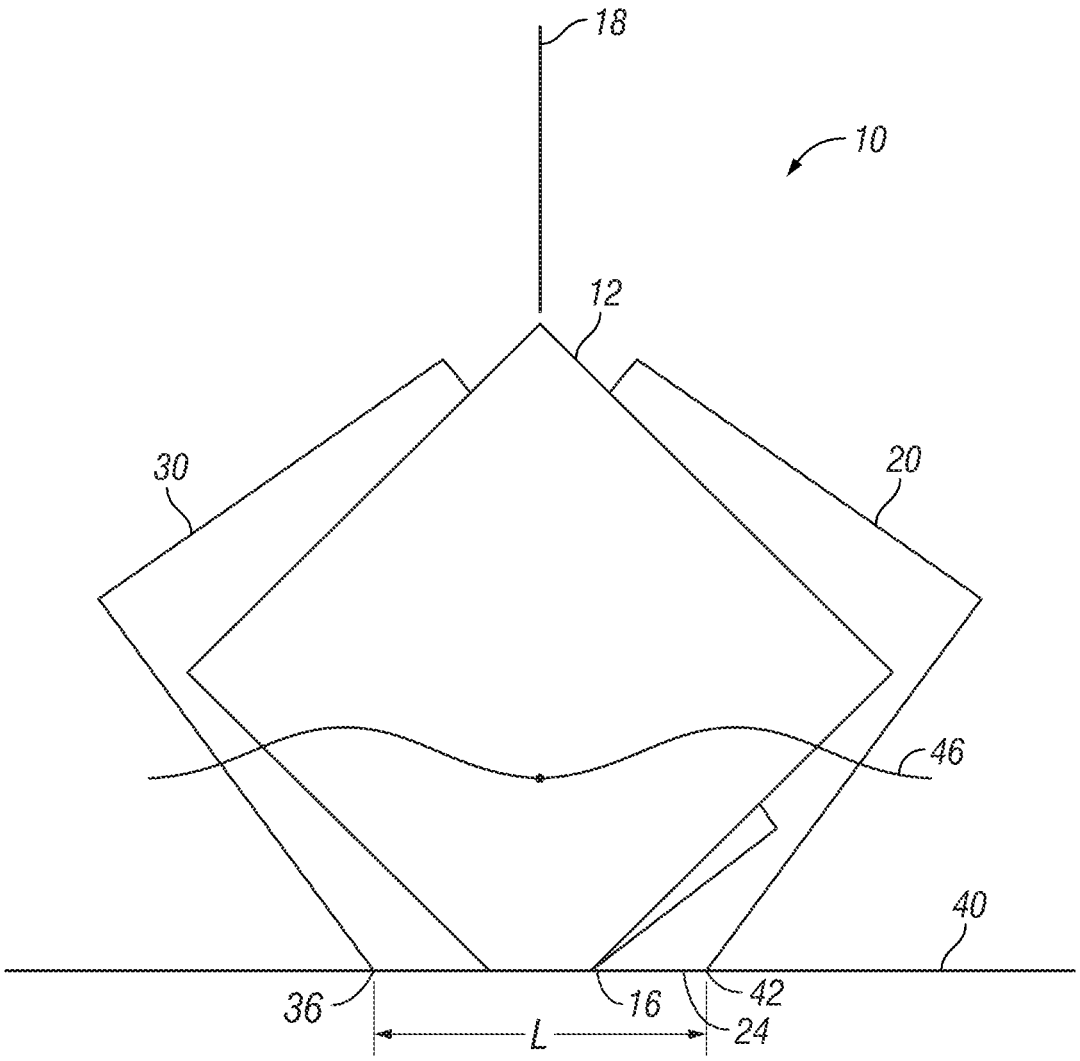
FIG. 4 depicts a rear assembled view of the three-sheet embodiment of a wrapping system of the present invention.
Figure 5:
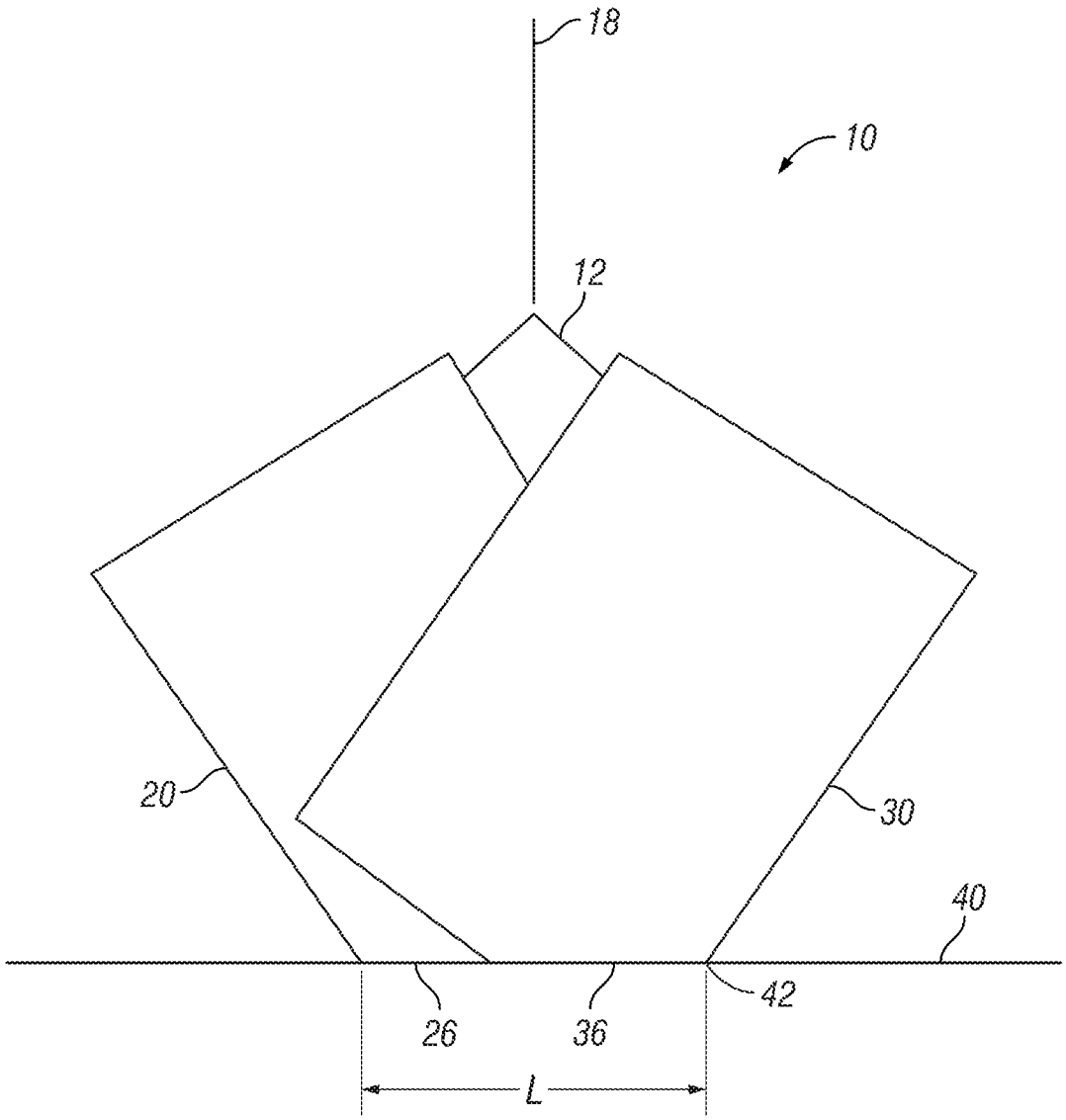
FIG. 5 depicts a front assembled view of the three-sheet embodiment of a wrapping system of the present invention.

The present invention provides a plant/floral arrangement wrapping system. The wrapping system can include a combination of protective sheets and decorative sheets. The protective sheets can include one or more sheets of, for example, craft paper, affixed together with a bonding element. The present invention contemplates the use of a material other than craft paper for the protective sheets. Other suitable materials include plastic, cardboard, fabrics, etc. The protective sheet can be unlaminated, laminated, or partially laminated.

The decorative sheets can include one or more sheets of, for example, finewrap affixed to the protective sheets with a bonding element. The present invention contemplates the use of a material other than craft paper for the decorative sheet. Other suitable materials include woven or non-woven materials, paper, plastic films, etc. The finewrap can be of unitary appearance, or in the alternative, can include decorative colors and/or designs.

Referring now to the drawing figures in which like reference designators refer to like elements, there is shown in FIGS. 1-6, a first embodiment of a plant/floral arrangement wrapping system 10 of the present invention. The wrapping system 10 includes a first sheet 12, which in an exemplary embodiment is substantially square in shape, having sides 14, each with a length X. In other embodiments, first sheet 12 is substantially rectangular in shape. A first corner C1 is removed from the sheet 12 along a line 16, where the opposite ends of line 16 are a distance X1 from corner C1. In this configuration the line 16 forms a sheet edge substantially perpendicular to a diagonal axis 18 of the first sheet 12. The removed sheet material can be recycled, repurposed, or discarded. As used herein, the removal of first corner C1 (or of any of the other corners described below) includes simple folding to give the appearance that first corner C1 has been physically separated from the rest of first sheet 12.

As described above, first sheet 12 is substantially square in shape in one embodiment and substantially rectangular in shape in another embodiment. It should be noted however, that first sheet 12, as well as any of the other sheets described below, can be other shapes as long as a portion of the sheet can be removed to form a side. Non-limiting examples of other possible shapes include triangular, oval, and circular.

The wrapping system 10 of the present invention includes a second sheet 20, which in an exemplary embodiment is substantially rectangular in shape, having opposing sides 22, each with a length Y, and opposing sides 24, each with a width Z. In other embodiments, second sheet 20 is substantially square in shape. A first corner C2 is removed from the sheet 20 along a line 26, where the opposite ends of the line 26 are a distance Y1 along a side 22 from corner C2, and a distance Z1 along a side 24 from corner C2. In this configuration the line 26 forms a sheet edge at an angle $\alpha$ to a diagonal axis 28 of the second sheet 20. In an exemplary embodiment, Y-Y1 is substantially equal to Z. The removed sheet material can be recycled, repurposed, or discarded.

The wrapping system 10 of the present invention includes a third sheet 30, where the third sheet 30 is a mirror image of the second sheet 20. The third sheet 30 is substantially rectangular in shape, having opposing sides 32, each with a length Y, and opposing sides 34, each with a width Z. In other embodiments, third sheet 30 is substantially square in shape. A first corner C2 is removed from the sheet 30 along a line 36, where the opposite ends of the line 36 are a distance Y1 along a side 32 from corner C2, and a distance Z1 along a side 34 from corner C2. In this configuration the line 36 forms a sheet edge at an angle β to a diagonal axis 38 of the second sheet 30. In an exemplary embodiment, Y-Y1 is substantially equal to Z. The removed sheet material can be recycled, repurposed, or discarded.

The wrapping system 10 is formed by combining the first 12, second 20, and third 30 sheets. The first sheet 12 is placed on flat surface, where the sheet edge formed by line 16 is aligned with a base plane 40. The second sheet 20 is positioned on the first sheet 12, where the sheet edge formed by line 26 is aligned with base plane 40. The third sheet 30 is positioned on the first sheet 12, partially overlapping the second sheet 20, where the sheet edge formed by line 36 is aligned with base plane 40. The second sheet 20 and third sheet 30 are aligned along the base plane 40, such that the base 42 of the wrapping system 10 has a length L, the second 20 and second 30 sheets intersect at point A along the diagonal axis 18 of the first sheet 12. The first 12, second 20, and third 30 sheets can be bonded together using a bonding agent, such as glue, double sided tape, and the like.

The first sheet 12 can be made of a craft paper, where the craft paper can be non-laminated, laminated, or partially laminated (for example laminated on one side). The second 20 and third 30 sheets can be made of a finewrap paper, where the finewrap paper can be of a unitary color and can also include a design element. As previously noted, materials other than craft paper and finewrap paper can be used. A decorative ribbon or string 46 such as a raffia can be affixed to first sheet 12 (and/or second 20 and third 30 sheets) to secure the wrapping system 10 about the flowers.

Figure 6:
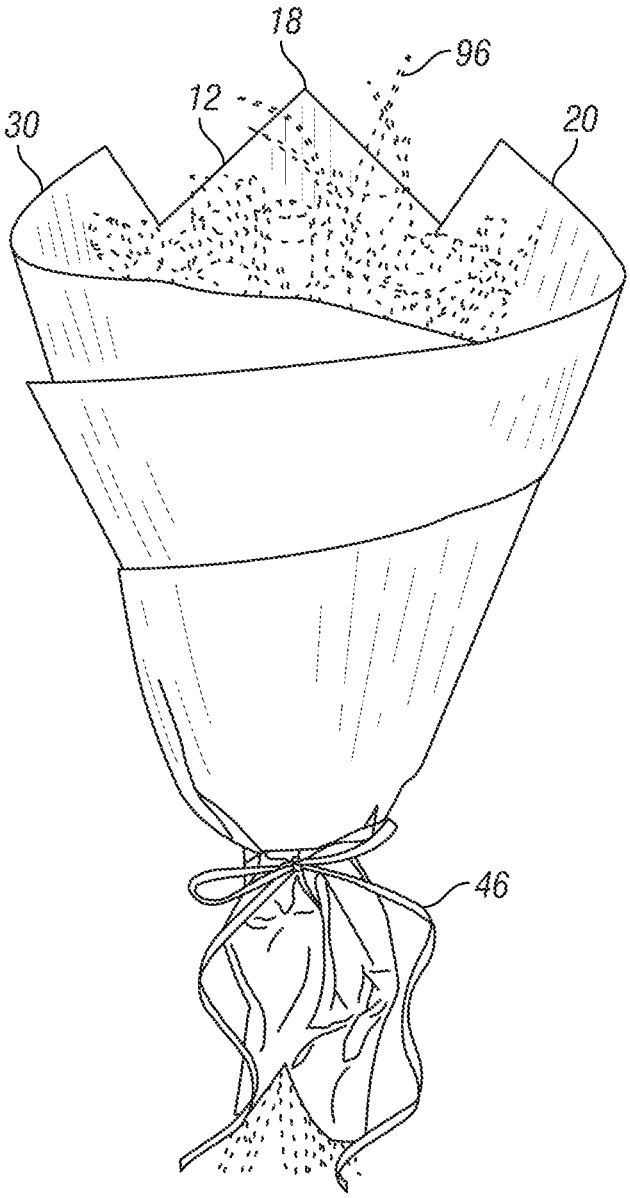
FIG. 6 depicts the wrapping system of FIGS. 1-5 in use about a flower bouquet.
Figure 8:
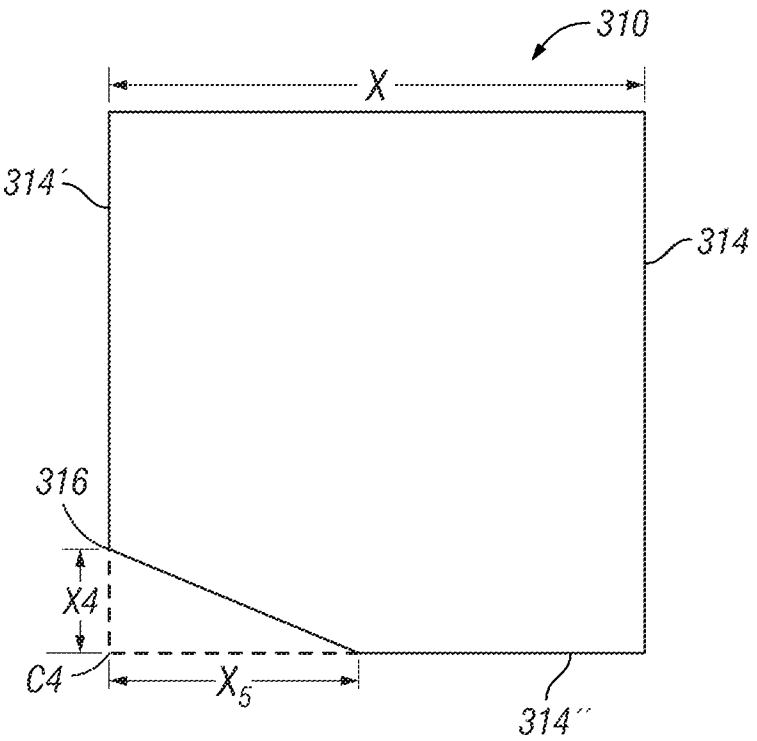
FIG. 8 depicts a second sheet for use with the first sheet of FIG. 7.
Figure 7:
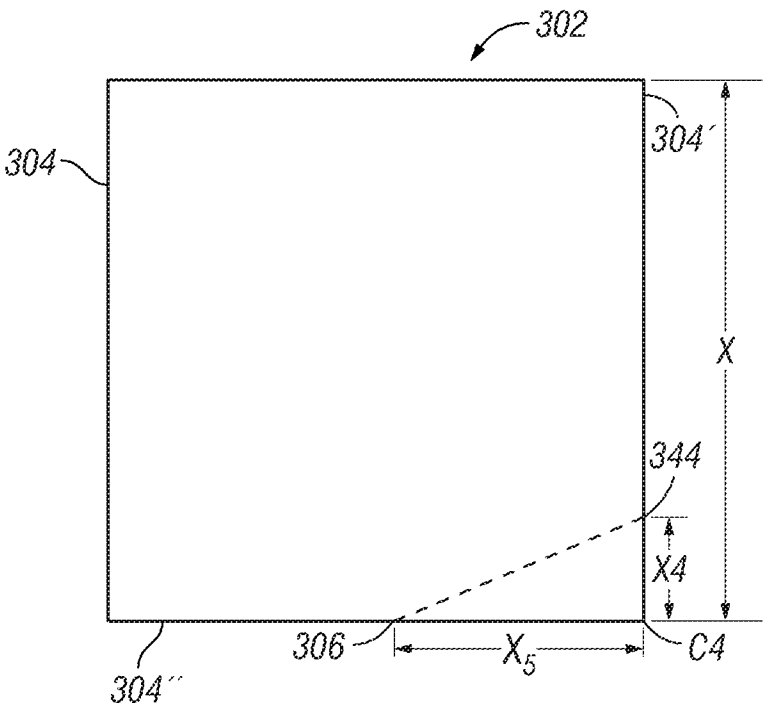
FIG. 7 depicts a first sheet of another three-sheet embodiment of a wrapping system of the present invention.
Figure 9:
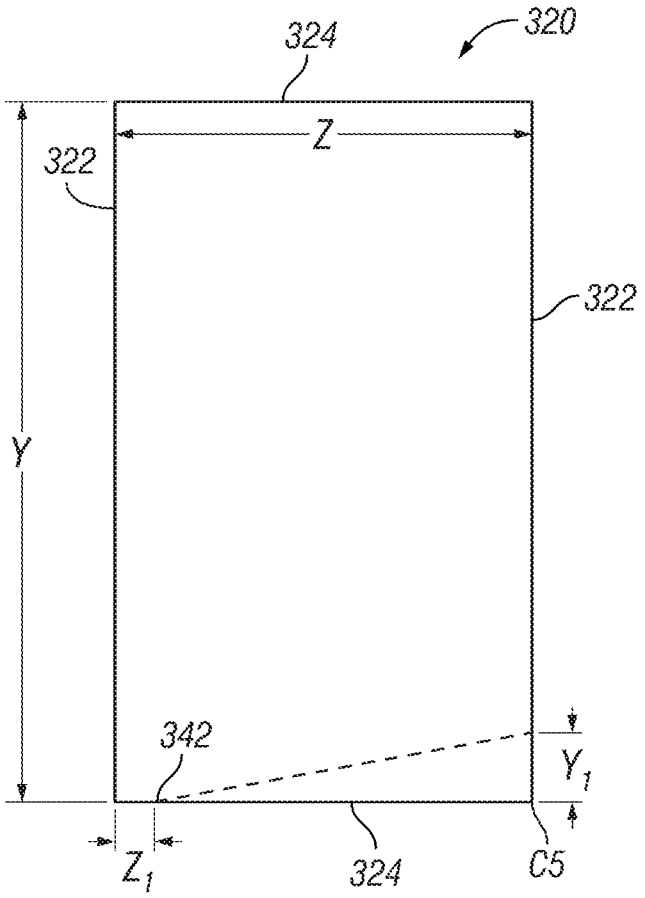
FIG. 9 depicts a third sheet for use with the first sheet of FIG. 7 and the second sheet of FIG. 8.

Referring to FIG. 6, in use, flowers 96 are positioned in wrapping system 10 along the central axis 18 of the wrapping system 10. The opposite edges of the second 20 and third 30 sheets are wrapped about the flowers 96 in an alternating fashion, such that an inner surface of the second sheet 20 overlaps an outer surface of the third sheet 30 (or vice versa). Of course, if the user decides to place the flowers 96 left or right of the central axis 18, the order (and extent) of wrapping of the second 20 and third 30 sheets can be changed to accommodate the placement of the flowers 96. The second 20 and third sheets 30 can be secured together using a bonding agent or folding over each other, thus securing the wrapping about the flowers 96. Additionally or alternatively, the decorative ribbon/string 46 can be utilized to secure the wrapping system 10 about the flowers 96.

FIGS. 7-12 show another plant/floral arrangement wrapping system 300 of the present invention. Like wrapping system 10, wrapping system 300 uses three sheets. The wrapping system 300 includes a first sheet 302, which in an exemplary embodiment is substantially square in shape, having sides 304, each with a length X. In other embodiments, first sheet 302 is substantially rectangular in shape. A first corner C4 is removed from the sheet 302 along a line 306, where the opposite ends of the line 306 are a distance X4 along a first side 304' from corner C4, and a distance X5 along a second side 304" from corner C4. In this configuration, X5 is greater than X4. In other configurations, X5 is less than or equal to X4. The removed sheet material can be recycled, repurposed, or discarded.

The wrapping system 300 of the present invention includes a second sheet 310, where the second sheet 310 is a mirror image of the first sheet 302. As such, the second sheet 310 is substantially square in shape, having sides 314, each with a length X. In other embodiments, second sheet 310 is substantially rectangular in shape. A first corner C4 is removed from the sheet 310 along a line 316, where the opposite ends of the line 316 are a distance X4 along a first side 314' from corner C4, and a distance X5 along a second side 314" from corner C4. In this configuration, X5 is greater than X4. In other configurations, X5 is less than or equal to X4. The removed sheet material can be recycled, repurposed, or discarded.

The wrapping system 300 of the present invention includes a third sheet 320, which in an exemplary embodiment is substantially rectangular in shape, having opposing sides 322, each with a length Y, and opposing sides 324, each with a width Z. In other embodiments, third sheet 320 is substantially square in shape. A first corner C5 is removed from the sheet 320 along a line 326, where the opposite end of the line 326 are a distance Y1 along a side 322 from corner C5, and a distance Z1 along a side 324 from corner C5. In this configuration Y1 is greater than Z1. In other configurations, X5 is less than or equal to X4. The removed sheet material can be recycled, repurposed, or discarded.

Figure 10:
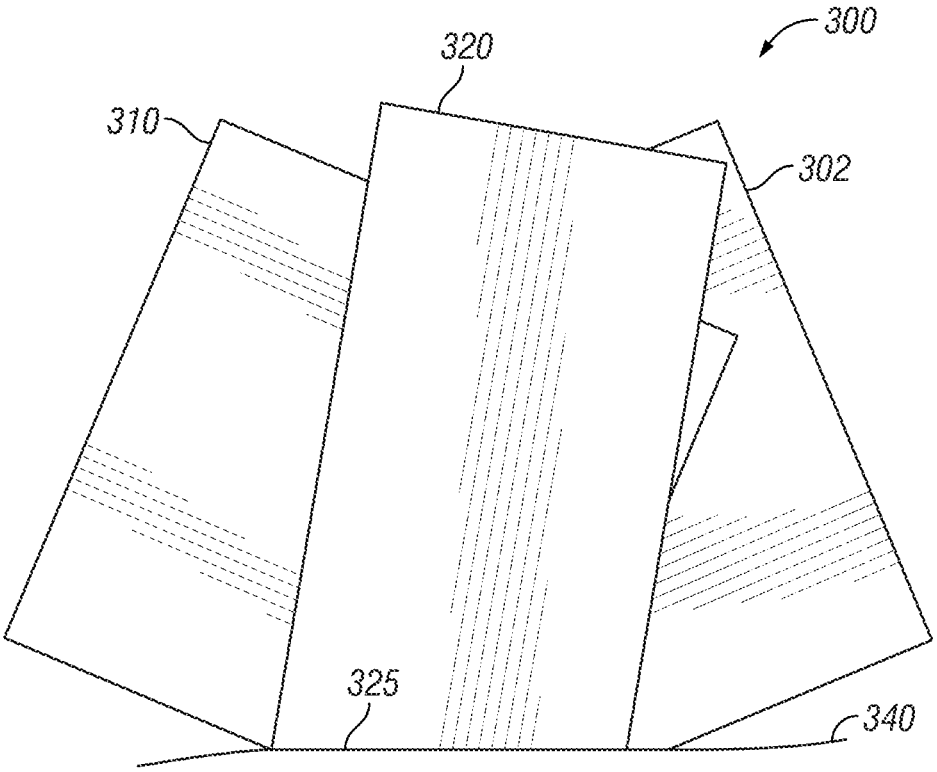
FIG. 10 depicts a rear assembled view of the three-sheet embodiment of the wrapping system of the present invention using the sheets of FIGS. 7-9.
Figure 11:
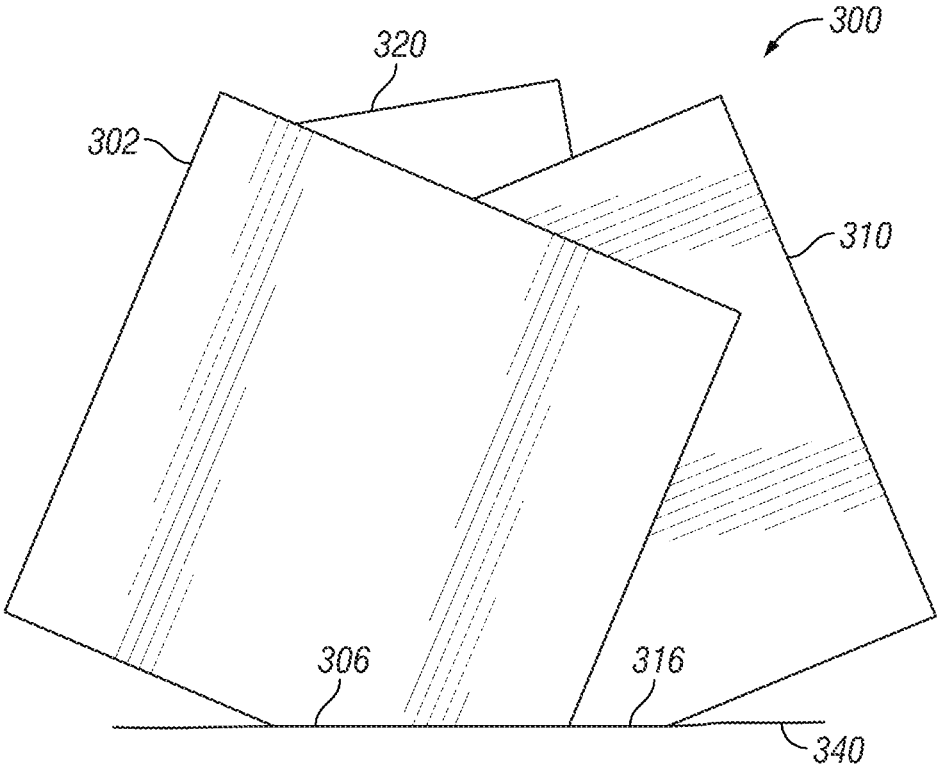
FIG. 11 depicts a front assembled view of the wrapping system of FIG. 10.

As best seen in FIGS. 10 and 11, wrapping system 300 is formed by combining the first 302, second 310, and third 320 sheets. The first sheet 302 is placed on a flat surface, where the sheet edge formed by line 306 is aligned with a base plane 340. The second sheet 310 is positioned on the first sheet 302, where the sheet edge formed by line 316 is aligned with base plane 340. The third sheet 320 is positioned on the first 302 and second 310 sheets, partially overlapping both sheets, where the sheet edge formed by line 326 is aligned with base plane 340 and point 342 of the third sheet 302 is positioned on top of point 344 of the first sheet 302. The first 302, second 310, and third 320 sheets can be bonded together using a bonding agent, such as glue, double sided tape, and the like.

Figure 12:
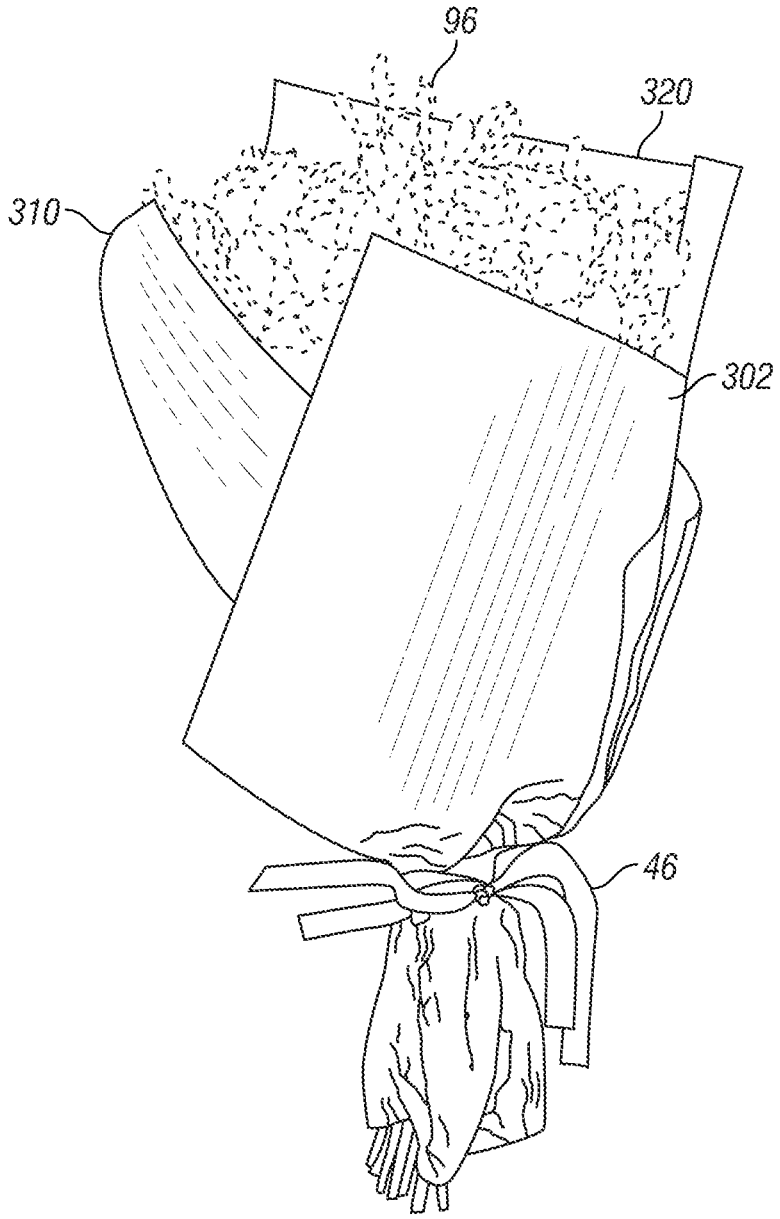
FIG. 12 depicts the wrapping system of FIGS. 7-11 in use about a flower bouquet.
Figure 14:
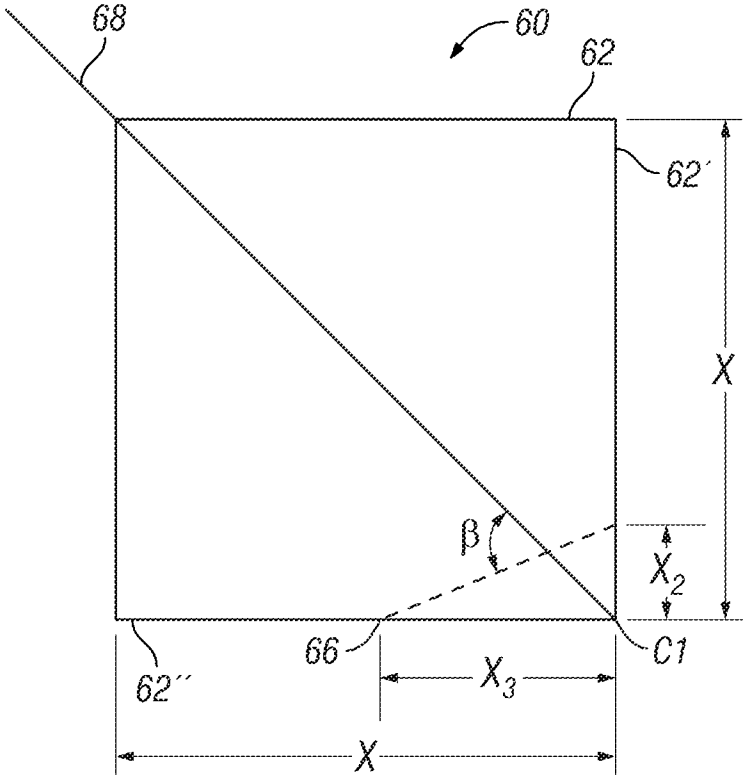
FIG. 14 depicts a second sheet for use with the first sheet of FIG. 13.
Figure 13:
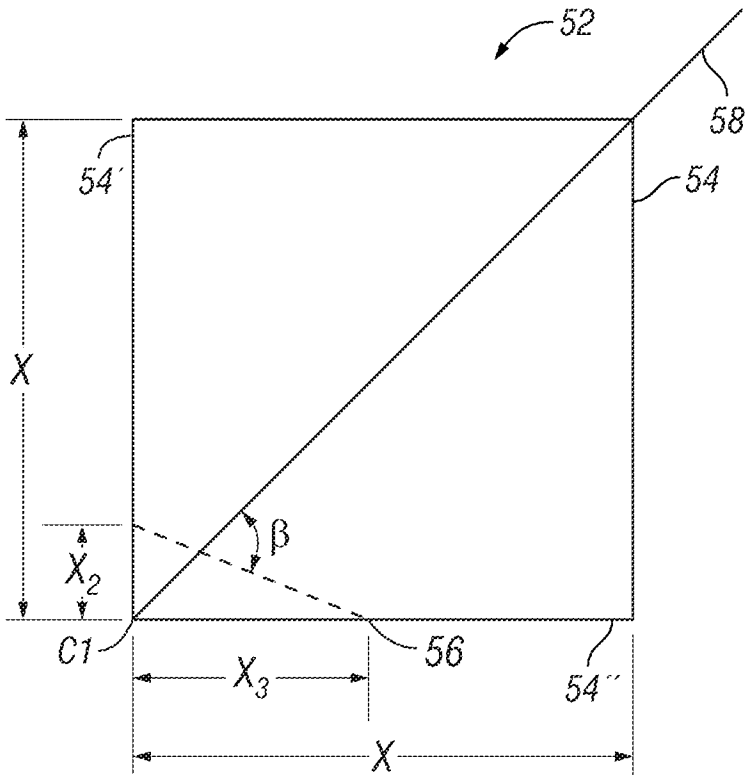
FIG. 13 depicts a first sheet of another embodiment of a wrapping system of the present invention.
Figure 16:
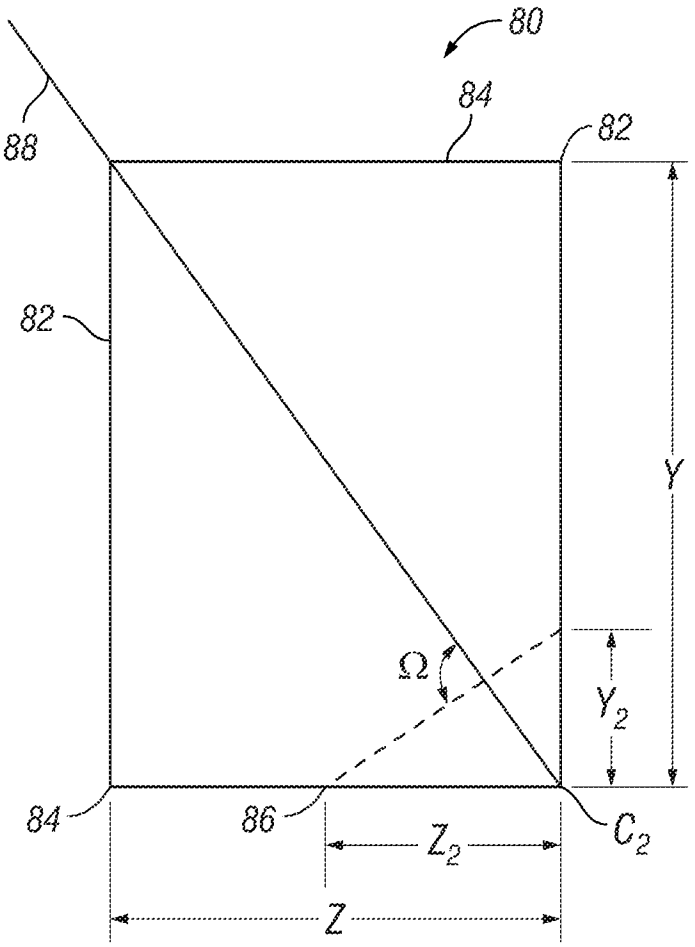
FIG. 16 depicts a fourth sheet for use with the first sheet of FIG. 13, the second sheet of FIG. 14, and the third sheet of FIG. 15.

The first 302 and second 310 sheets can be made of a craft paper, where the craft paper can be non-laminated, laminated, or partially laminated (for example laminated on one side). The third sheet 320 can be made of a finewrap paper, where the finewrap paper can be of a unitary color and can also include a design element. As previously noted, materials other than craft paper and finewrap paper can be used. A decorative ribbon or string such as a raffia can be affixed to any one of the first 302, second 310, and third 320 sheets to secure the wrapping system 300 about the flowers. Referring to FIG. 12, in use, flowers 96 are positioned in wrapping system 300. The opposite edges of the first 302 and second 310 sheets are wrapped about the flowers 96 in an alternating fashion, such that an inner surface of the first sheet 302 overlaps an outer surface of the second sheet 310 (or vice versa).

FIGS. 13-19 show another plant/floral arrangement wrapping system 50 of the present invention. The wrapping system 50 includes a first sheet 52 shown in FIG. 13, which in an exemplary embodiment is substantially square in shape, having sides 54, each with a length X. In other embodiments, first sheet 52 is substantially rectangular in shape. A first corner C1 is removed from the sheet 52 along a line 56, where the opposite ends of the line 256 are a distance X2 along a first side 54' from corner C1, and a distance X3 along a second side 54" from corner C1. In this configuration the line 56 forms a sheet edge at an angle β to a diagonal axis 58 of the second sheet 50. Depending on the desired look, X3 can be greater than, less than, or equal to X2. The removed sheet material can be recycled, repurposed, or discarded.

The wrapping system 50 includes a second sheet 60, where the second sheet 60 is a mirror image of the first sheet 52. As such, in an exemplary embodiment shown in FIG. 14, second sheet 60 is substantially square in shape, having sides 64, each with a length X. In other embodiments, second sheet 60 can be substantially rectangular. A first corner C1 is removed from the sheet 60 along a line 66, where the opposite ends of the line 66 are a distance X2 along a first side 62' from corner C1, and a distance X3 along a second side 62" from corner C1. In this configuration the line 66 forms a sheet edge at an angle β to a diagonal plane 68 of the second sheet 60. Depending on the desired look, X3 can be greater than, less than, or equal to X2. The removed sheet material can be recycled, repurposed, or discarded.

Figure 15:
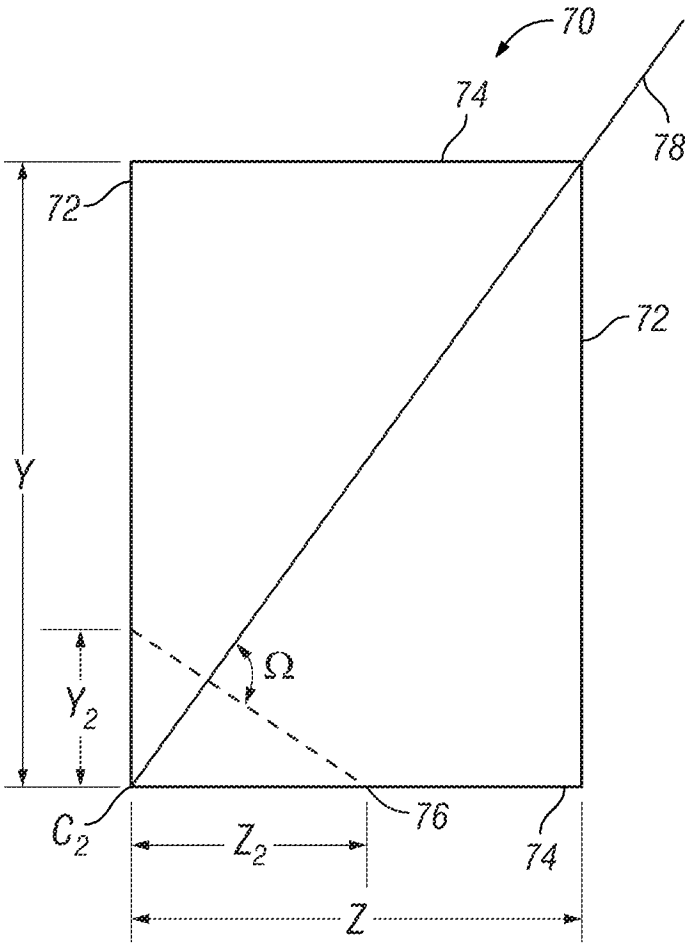
FIG. 15 depicts a third sheet for use with the first sheet of FIG. 13 and the second sheet of FIG. 14.

The wrapping system 50 includes a third sheet 70, which as shown in FIG. 15 in an exemplary embodiment is substantially rectangular in shape, having opposing sides 72, each with a length Y, and opposing sides 74, each with a width Z. In other embodiments, third sheet 70 is substantially square in shape. A first corner C2 is removed from the sheet 70 along a line 76, where the opposite end of the line 76 are a distance Y2 along a side 72 from corner C2, and a distance Z2 along a side 74 from corner C2. In this configuration the line 76 forms a sheet edge at an angle Ω to a diagonal axis 78 of the third sheet 70. Depending on the desired look, Z2 can be greater than, less than, or equal to Y2. The removed sheet material can be recycled, repurposed, or discarded.

The wrapping system 50 includes a fourth sheet 80, where the fourth sheet 80 is a mirror image of the third sheet 70. As such, in an exemplary embodiment shown in FIG. 16, fourth sheet 80 is substantially rectangular in shape, having opposing sides 82, each with a length Y, and opposing sides 84, each with a width Z. In other embodiments, fourth sheet 80 is substantially square in shape. A first corner C2 is removed from the sheet 80 along a line 86, where the opposite end of the line 86 are a distance Y2 along a side 82 from corner C2, and a distance Z2 along a side 84 from corner C2. In this configuration, the line 86 forms a sheet edge at an angle Ω to a diagonal axis 88 of the fourth sheet 80. Depending on the desired look, Z2 can be greater than, less than, or equal to Y2. The removed sheet material can be recycled, repurposed, or discarded.

Figure 17:
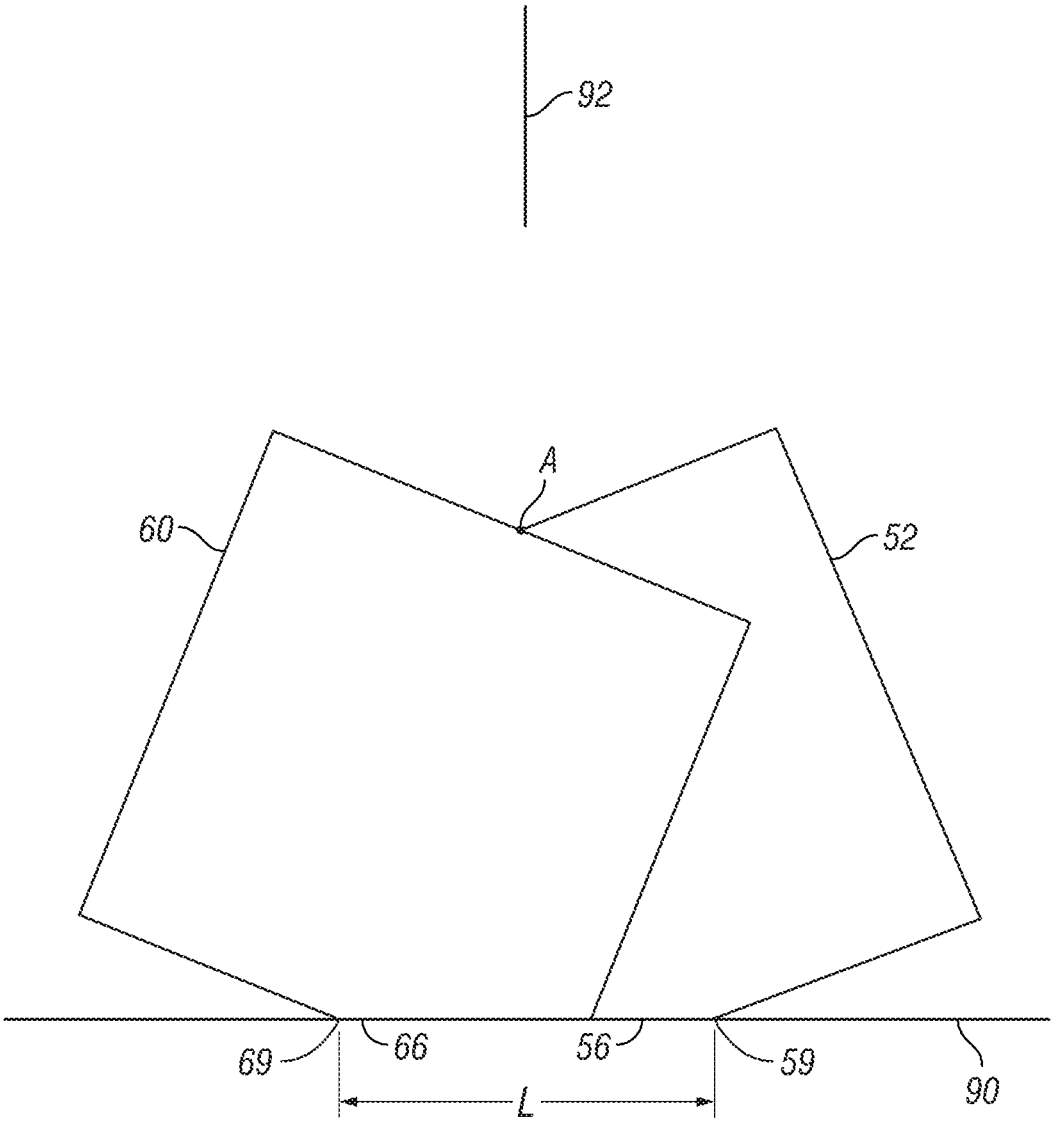
FIG. 17 depicts a front partial assembled view of a wrapping system of the present invention using the sheets of FIGS. 13-16.

The wrapping system 50 is formed by combining the first 52, second 60, third 70, and fourth 80 sheets. The first sheet 52 is placed on flat surface, where the sheet edge formed by line 56 is aligned with a base plane 90. As shown in FIG. 17, the second sheet 60 is positioned on the first sheet 52, where the sheet edge formed by line 66 is aligned with the base plane 90. The first 52 and second 60 sheets are symmetrically positioned about an axis 92 perpendicular to the base plane 90, such that the top edges of the first 52 and second 60 sheets intersect at point A on the axis 92 and the combined length of the bottom edges of the first 52 and second 60 sheets on base plane 90 has a length L.

Figure 18:
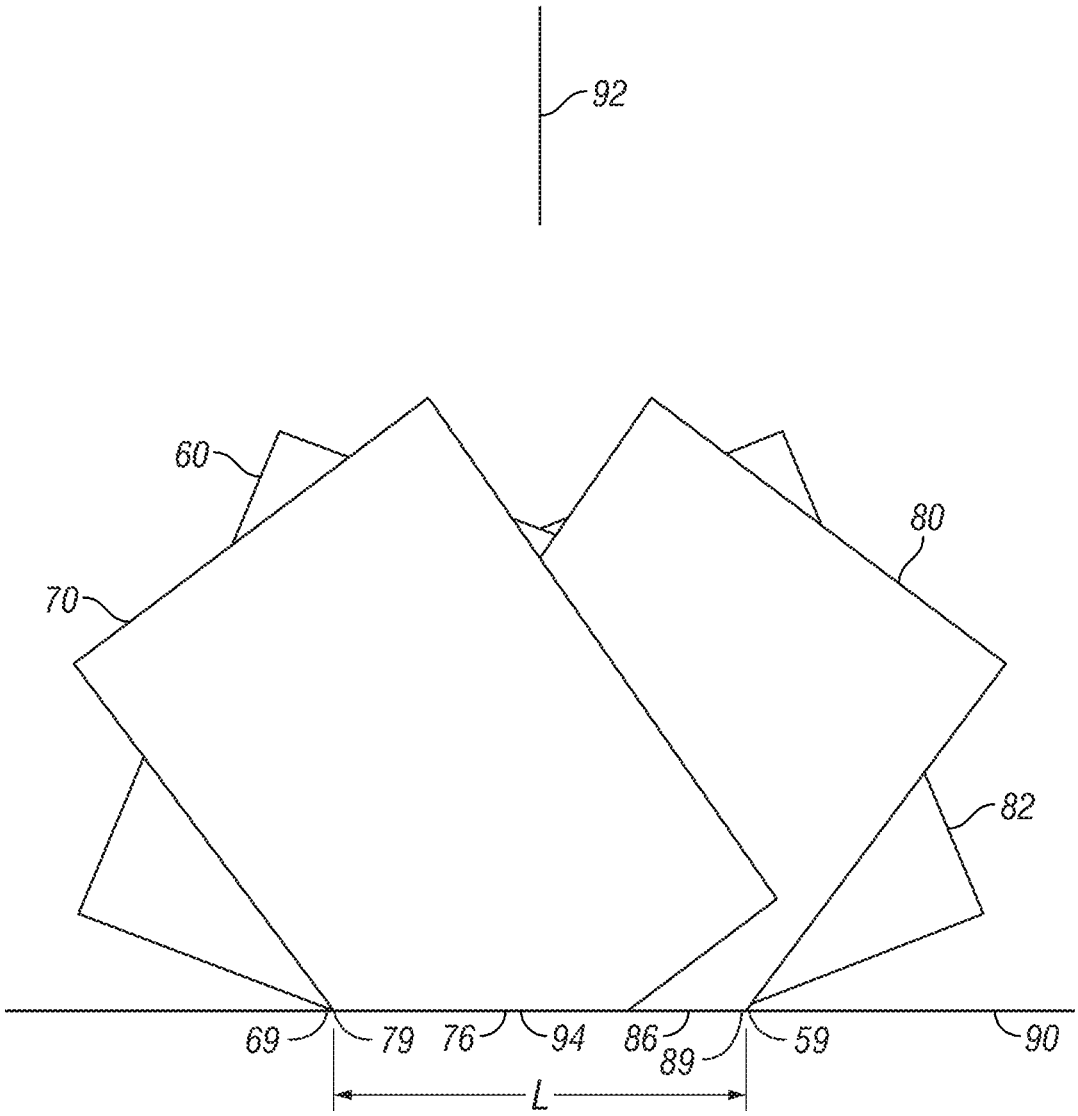
FIG. 18 depicts a front assembled view of the wrapping system of the present invention using the sheets of FIGS. 13-16.

As shown in FIG. 18, the fourth sheet 80 is positioned on the first sheet 52, partially overlapping the second sheet 60, where the sheet edge formed by line 86 is aligned with base plane 90 and the end 89 of line 86 is aligned with the end 59 of line 56 on the first sheet 52. The third sheet 70 is positioned on the second sheet 60, partially overlapping the first 52 and fourth 80 sheet, where the sheet edge formed by line 76 is aligned with base plane 90 and the end 79 of line 76 is aligned with the end 69 of line 66 on the second sheet 60. In this configuration the base 94 of the wrapping system 50 still has the length L. The first 52, second 60, third 70, and fourth 80 sheets can be bonded together using a bonding agent, such a glue, double sided tape and the like.

The first 52 and second 60 sheets can be made of a craft paper, where the craft paper can be non-laminated, laminated, or partially laminated. The third 70 and fourth 80 sheets can be made of a finewrap paper, where the finewrap paper can be of a unitary color, of can also include a design element. As previously noted, materials other than craft paper and finewrap paper can be used.

Figure 19:
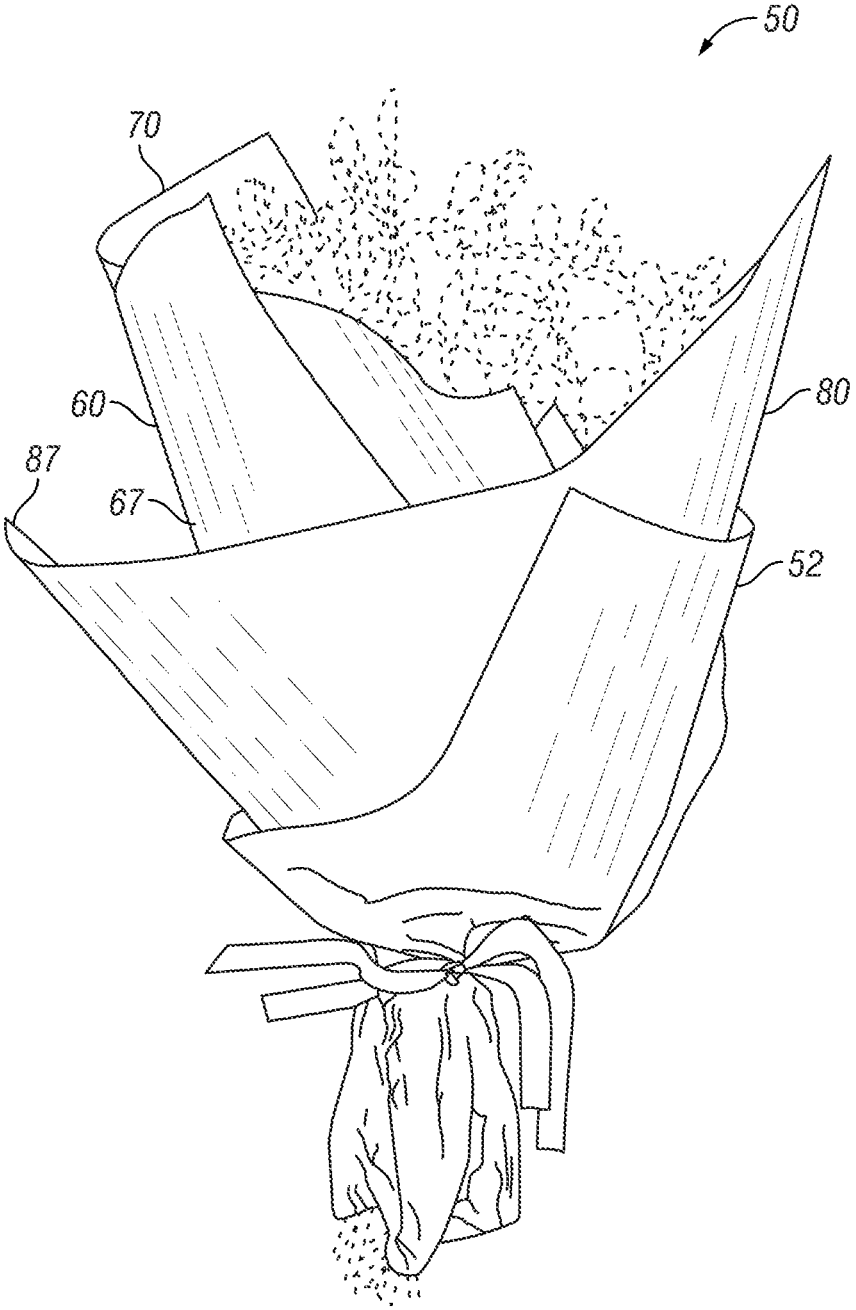
FIG. 19 depicts the wrapping system of FIGS. 13-18 in use about a flower bouquet.

Referring to FIG. 19, in use, flowers 96 are positioned on the third 70 and fourth 80 sheets, along the central axis 92 of the wrapping system 50. The opposite edges of the first 52 and second 60 sheets are wrapped about the flower in an alternating fashion, such that an inner surface 87 of the fourth sheet 80 overlaps an outer surface 67 of the second sheet 60. Of course, if the user decides to place the flowers 96 left or right of the central axis 92, the order (and extent) of wrapping of the first 52 and second 60 sheets can be changed to accommodate the placement of the flowers 96. The fourth 80 and second sheets 60 can be secured together using a bonding agent, thus securing the wrapping about the flower. Additionally or alternatively, a decorative ribbon/string can be utilized to secure the wrapping system 50 about the flowers.

Figure 21:
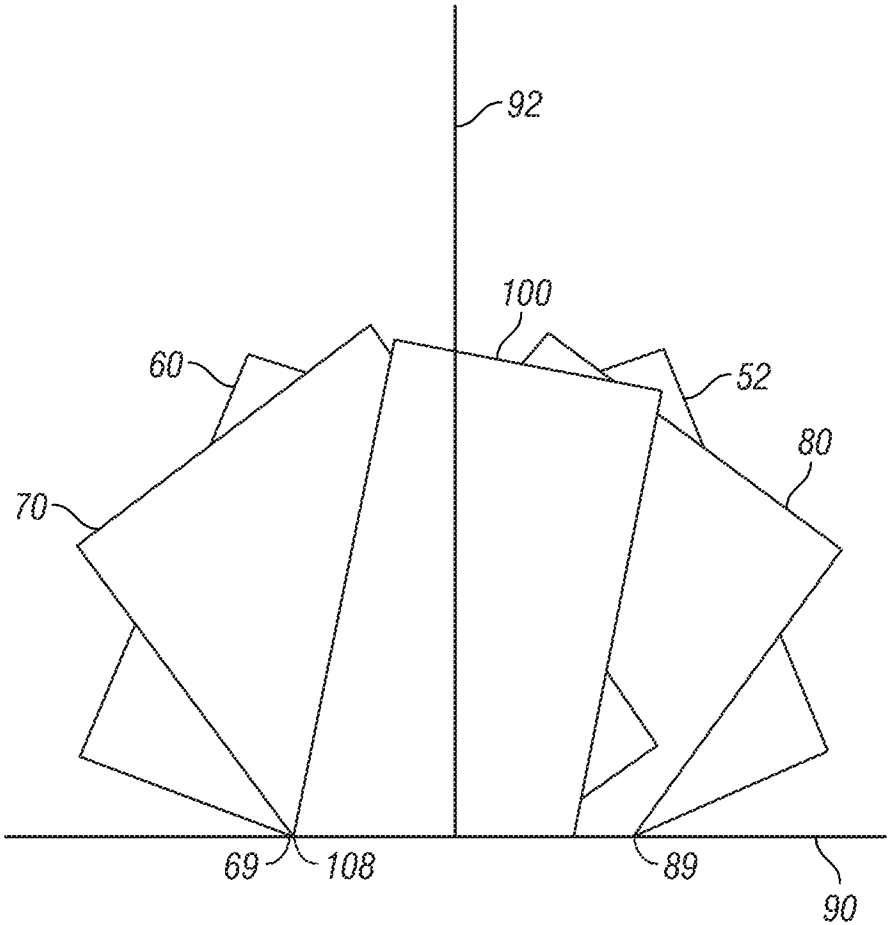
FIG. 21 depicts a front assembled view of another wrapping system of the present invention including the fifth sheet of FIG. 20 and the sheets of FIGS. 13-16.
Figure 20:
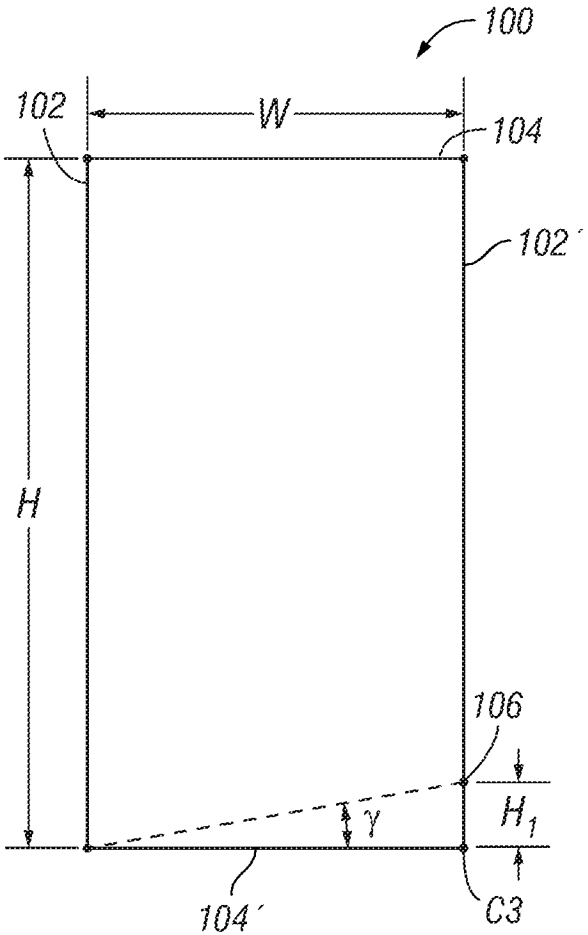
FIG. 20 depicts a fifth sheet for use with the sheets of FIGS. 13-16.
Figure 22:
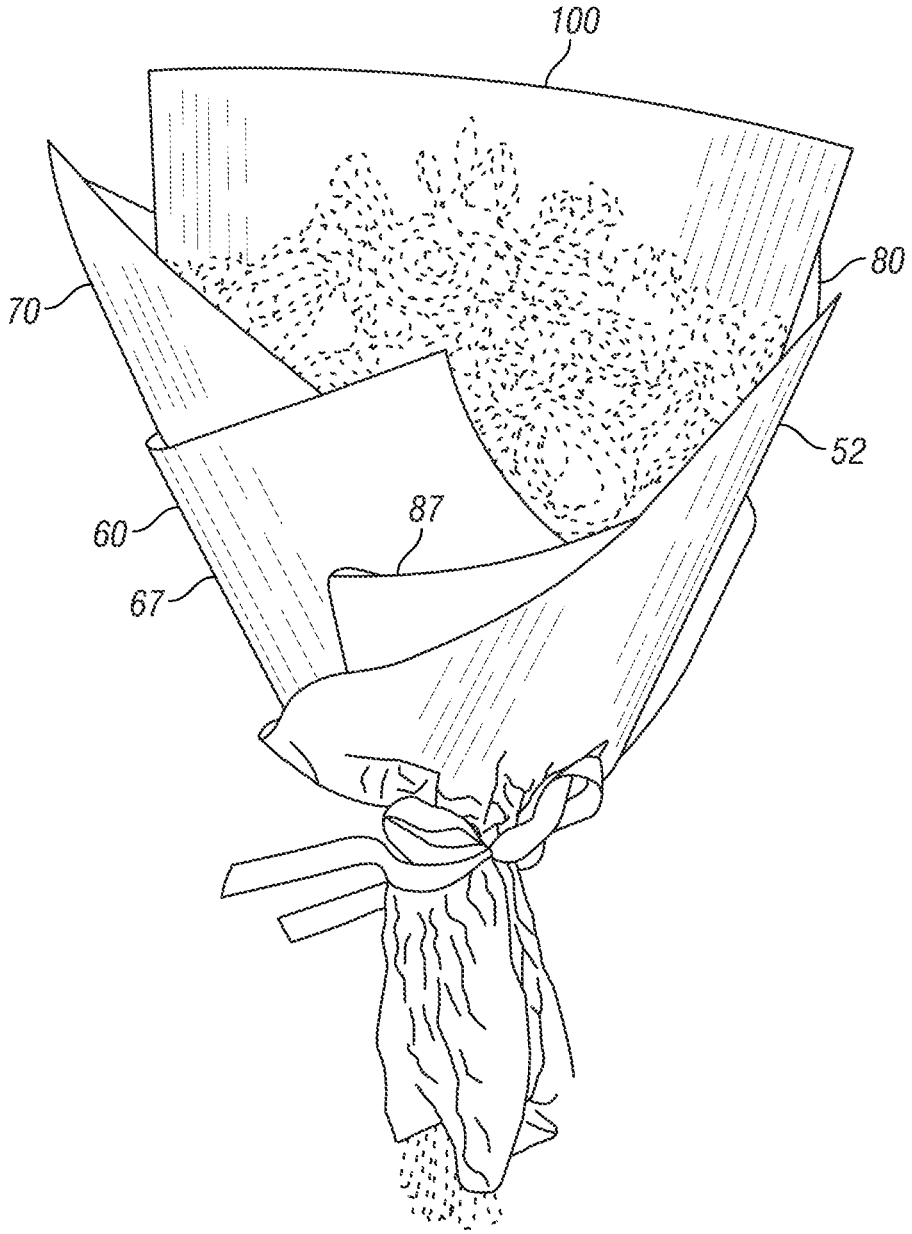
FIG. 22 depicts the wrapping system of FIG. 21 in use about a flower bouquet.

Referring to FIGS. 20-22, the wrapping system 50 can further include a fifth sheet 100. In the embodiment shown in FIG. 20, fifth sheet 100 is substantially rectangular in shape, having opposing side 102 and 102', each with a length H, and opposing sided 104 and 104', each with a width W. In other embodiments, fifth sheet 100 is substantially square in shape. The side 104" is removed from the sheet 100 along a line 106, where an end of the line 106 is a distance H1 alongside 102' from corner C3. In this configuration the line 106 forms a sheet edge at an angle μ to a base of the rectangular sheet 100. The removed sheet material can be recycled, repurposed, or discarded.

Starting with the configuration shown in FIG. 18 and as shown in FIG. 21, the fifth sheet 100 is positioned on the third sheet 70, partially overlapping the fourth sheet 80, where the sheet edge formed by line 106 is aligned with base plane 90 and the end 108 of line 106 is aligned with the end 69 of line 66 on the second sheet 60. The fifth sheet 100 can be bonded to the wrapping using a bonding agent, such a glue, double sided tape and the like.

Referring to FIG. 22, in use, flowers 96 are positioned on the fifth sheet 100. The opposite edges of the first 52 and second 60 sheets are wrapped about the flower in an alternating fashion, such that an inner surface 87 of the fourth sheet 80 overlaps an outer surface 67 of the second sheet 60. Of course, if the user decides to place the flowers 96 left or right of the central axis 92, the order (and extent) of wrapping of the first 52 and second 60 sheets can be changed to accommodate the placement of the flowers 96. The fourth 80 and second sheets 60 can be secured together using a bonding agent, thus securing the wrapping about the flower. Additionally or alternatively, a decorative ribbon/sting can be utilized to secure the wrapping system 50 about the flowers.

Figure 23:
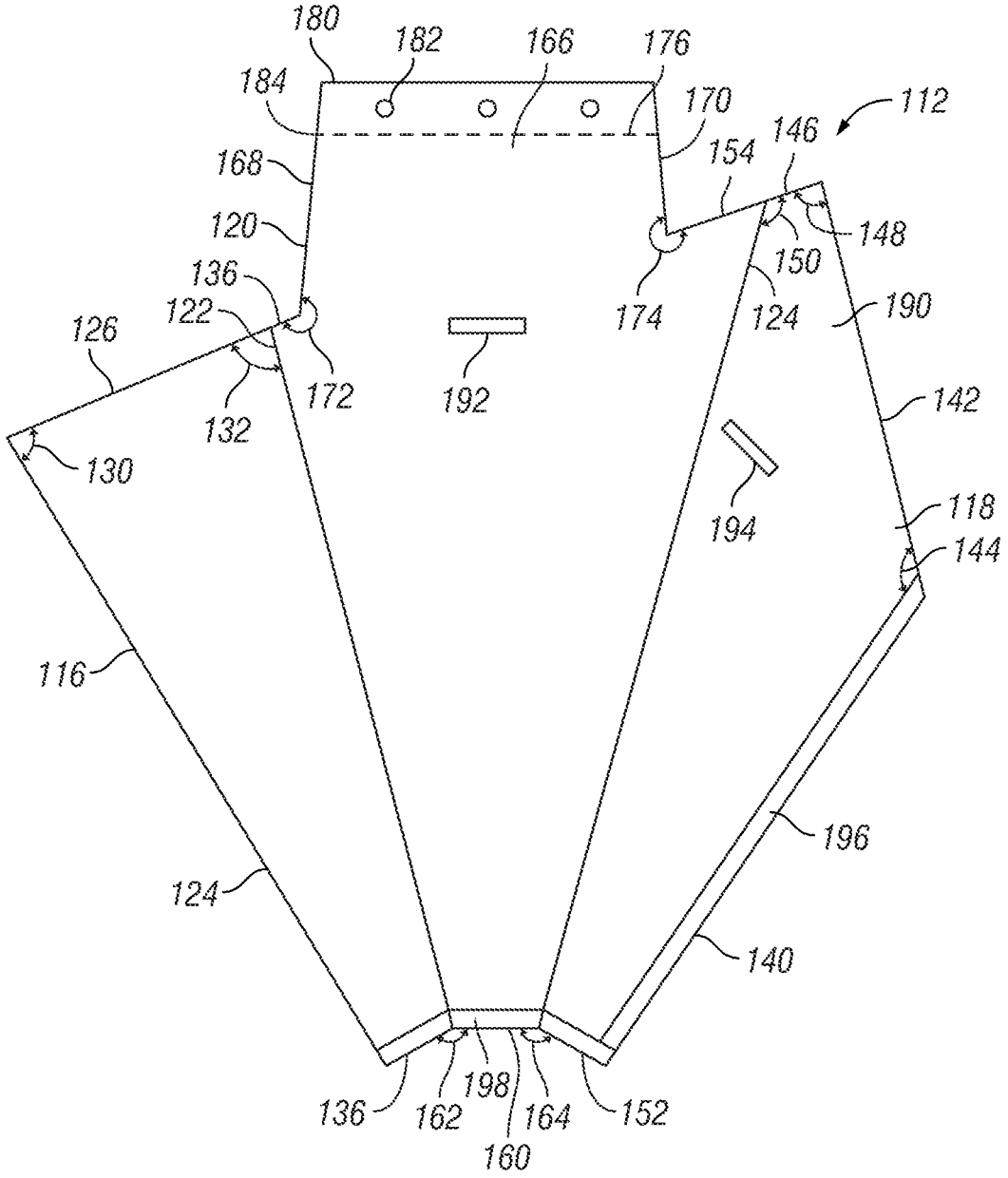
FIG. 23 depicts a first side of an alternative protective sheet of a wrapping system of the present invention.
Figure 24:
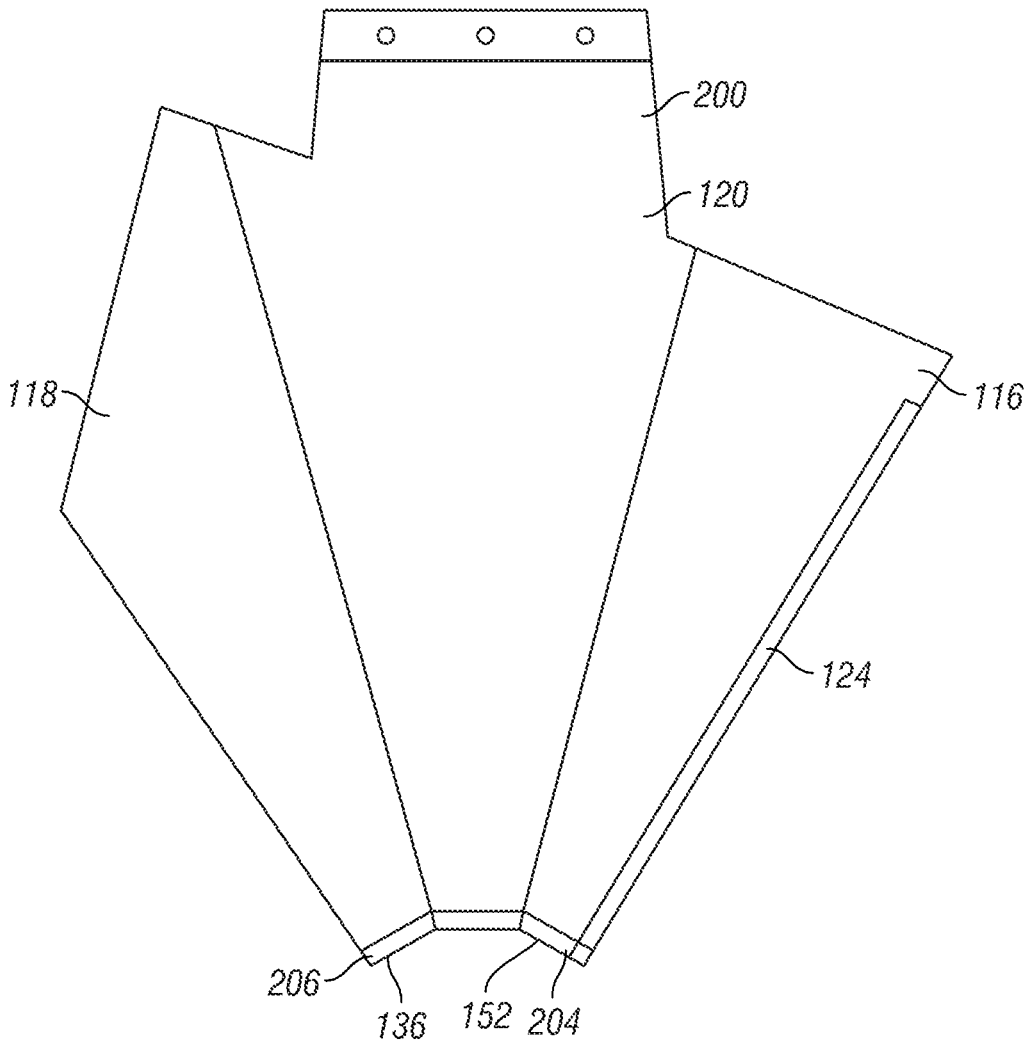
FIG. 24 depicts a second side of the protective sheet of FIG. 23.

Referring to FIGS. 23-28, another plant/floral arrangement wrapping system 110 of the present invention in provided. The wrapping system 110 includes a protective sheet 112 and a decorative sheet 114. With reference to FIGS. 23 and 24, the protective sheet 112 is provided in a unique geometry. The geometry includes three sections: first 116 and second 118 outer sections, and a center section 120. In some embodiments, folding guides, such as for example a crease, separate the three sections, where a first folding guide 122 is interposed between the first outer section 116 and the center section 120, and a second folding guide 124 is interposed between the center section 120 and the second outer section 118. In other embodiments, there are no folding guides on protective sheet 112. In such embodiments, a template can be used as de facto folding guides.

The first outer section 116 can take the form of a truncated triangle having a first side 124 forming an outer side edge of the first section 116, and a second side 126 forming a top edge of the first section 116. An angle 130 is interposed between the first and second sides 116, 126. The first folding guide 122 forms the third side, where angle 132 is interposed between the second and third sides 126, 122. The tip of the triangle is truncated, forming the bottom edge 136 of the first section 116. The folding guide 122 at least partially intersects the section side 126, such that a portion 136 of the second side 126 is incorporated into the center section 120.

The second outer section 118 includes lower and upper side edges 140, 142, where an angle 144 in interposed between the lower and upper side edges 140, 142. A top edge 146 extends from the upper side edge 142, where an angle 148 is interposed between the top edge 146 and the upper side edge 142. The second folding guide 124 forms the inner boundary of the second outer section 118, where angle 150 in interposed between the top edge 146 and the second folding guide 124. A bottom edge 152 is interposed between the lower side edge 140 and the second folding guide 124. The second folding guide 124 at least partially intersects the top edge 146, such that a portion 154 of the top edge 146 is incorporated into the center section 120.

The center section 120 is bounded by the first and second folding guides 122, 124, and include a truncated bottom edge 160, interposed between the bottom edge 136 of the first outer section 116, and the bottom edge 152 of the second outer section 118. The bottom edges 136, 152, and 160 are shown as being substantially equal in length, but in other embodiments, bottom edges 136, 152, and 160 have different lengths. An angle 162 is interposed between bottom edges 136 and 160, and an angle 164 is interposed between bottom edges 154 and 160. Additionally, a bottom folding guide is positioned adjacent to and spanning the lengths of the bottom edges 136, 152, and 160.

A top portion 166 of the center section 120 include a first and second side edges 168, 170. The first side edge 168 extends from the portion 136 of the second side 126 of the first outer section 114, where an angle 172 is interposed between the second side 126 of the first outer section 116 the first side edge 168 of the top portion 166. The second side edge 170 extends from the portion 154 of the top edge 146 of the second outer section 118, where an angle 174 is interposed between top edge 146 of the second outer section 118 the second side edge 170 of the top portion 166. A top edge 176 of the top portion 166 extends between the first and second side edges 168, 170. Optionally, a removeable header 180 can be affixed to the top edge 176 of the top portion 166, where the removable header 180 can include guide holes 182 for display purposes.

Additionally, the removable header 180 can be used to affix multiple wrapping system 110 together, forming a bundle of wrapping systems 110. The bundling of the multiple wrapping system 110 allows for easy of storage and shipping. When a wrapping system 110 is needed by a user, it can be removed from the bundle by separating the wrapping system 110 from the header 180, for example by tearing away the wrapping system 110 along a perforated tear line 184 between the header 110 and the top portion 166.

The protective sheet 112 further includes a number of bonding elements, such as for example an adhesive, double sided tape, affixed thereto. The bonding elements can be used to secure the decorative sheet 114 to the protective sheet 112 and secure the protective sheet 112 in a folding configuration. With reference to FIG. 23, an inner surface 190 of the protective sheet 112 can include bonding elements 192 and 194, positioned on the center 120 and second outer sections 118. Bonding elements 192 and 194 are used to secure the decorative sheet 114 to the protective sheet 112.

The inner surface 190 further includes bonding element 196, positioned along the lower side edge 140 of the second outer section 118, and bonding element 198, positioned along the bottom edge 160 of the center section. 120. Referring also to FIG. 24, the outer surface 200 of the protective sheet 112 includes bonding element 202, positioned along the side edge 124 of the first outer section 116, and bonding element 198, positioned along the bottom edge 136 of the first outer section 116. Bonding element 206 is positioned along the bottom edge 152 of the second outer section 118. These bonding elements are utilized to secure the protective sheet 112 in a folding configuration, as will be described in further detail below.

Figure 25:
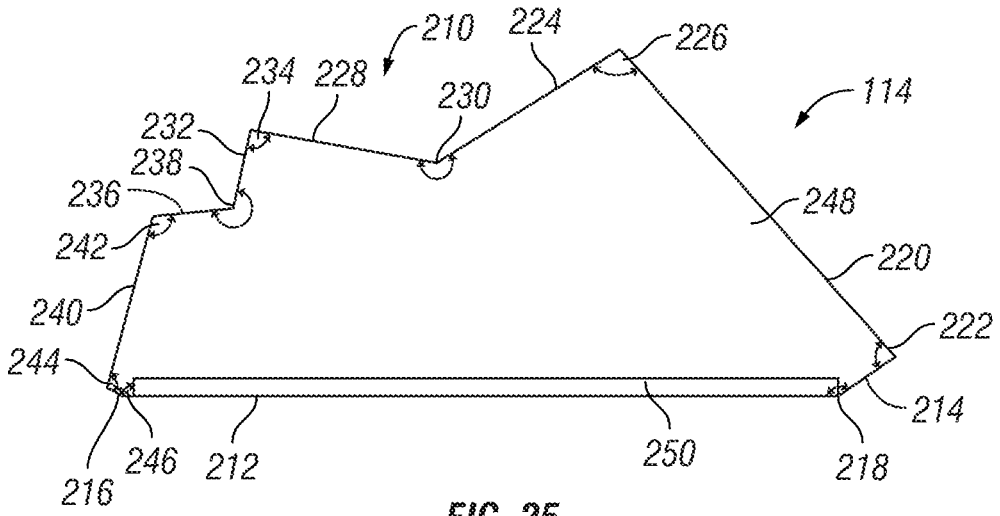
FIG. 25 depicts a decorative sheet of the alternative wrapping system of the present invention.

Referring to FIG. 25, decorative sheet 114 includes a top edge 210 having a unique geometry, and a bottom edge 212. Side edges 214, 216 extend between the top edge 210 and the bottom edge 212. The bottom edge 212 is substantially linear, where the first side edge 214 extends at a non-orthogonal angle 218 therefrom. In other embodiments, bottom edge 212 is not linear, but first side edge 214 still extends at a non-orthogonal angle 218 from bottom edge 212.

The top edge 210 includes a first portion 220 extending from the first side edge 214 opposite the bottom edge 212, where an angle 222 is interposed between the first portion 220 and the first side edge 214. A second portion 224 of the top edge 210 extends from the first portion 220, opposite the first side edge 214, where an angle 226 is interposed between the first and second portions 220 and 224. A third portion 228 of the top edge 210 extends from the second portion 224, opposite the first portion 220, where an angle 230 is interposed between the second and third portions 224 and 228. A fourth portion 232 of the top edge 210 extends from the third portion 228, opposite the second portion 224, where an angle 234 is interposed between the third and fourth portions 228 and 232. A fifth portion 238 of the top edge 210 extends from the fourth portion 232, opposite the third portion 232, where an angle 238 is interposed between the fourth and fifth portions 232, 236. A fifth portion 238 of the top edge 210 extends from the fourth portion 232, opposite the third portion 232, where an angle 238 is interposed between the fourth and fifth portions 232, 236. A sixth portion 240 of the top edge 210 extends from the fifth portion 236, opposite the fourth portion 2332, where an angle 242 is interposed between the fifth and sixth portions 236, 240.

The second side edge 216 is disposed between the bottom edge 212 and the sixth portion 240 of the top edge 210. An angle 244 interposed between the sixth portion 240 of the top edge 210 and the second side edge 216, and an angle 246 interposed between the second side edge 216 and the bottom edge 212.

The decorative sheet 114 further includes one or more bonding element affixed thereto. The bonding elements can be used to secure the decorative sheet 114 to the protective sheet 112. With reference to FIG. 25, an inner surface 248 of the decorative sheet 114 includes bonding element 250, positioned along the bottom edge 212 of the decorative sheet 114.

Figure 26:
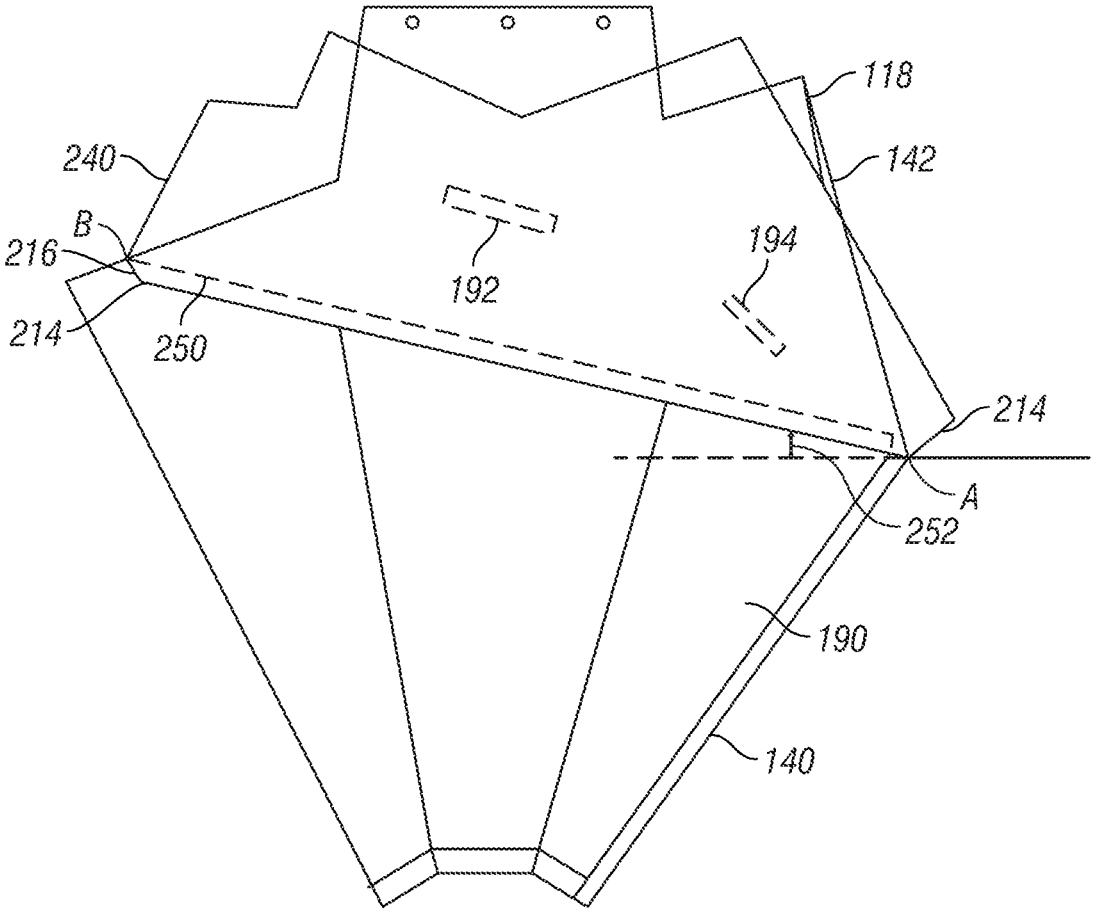
FIG. 26 depicts a front assembled view of the alternative wrapping system of the present invention including the fifth sheet.

Referring to FIG. 26, the decorative sheet 114 is affixed to the inner surface 190 of the protective sheet 112, using bonding elements 192 and 194 on the inner surface 190 of the protective sheet 112, and the bonding element 250 on the inner surface 240 of the decorative sheet 112. The decorative sheet 114 is aligned on the protective sheet 112, by positioning the interface between the bottom edge 212 and first side edge 214 of the decorative sheet 114 on the interface between the lower and upper side edges 140, 142 of the second section 118 of the protective sheet 112, point A. The bottom edge 212 of the decorative sheet extends at angle 252 from a horizontal plane extending across the protective sheet 112, such the interface between the second side edge 216 and the sixth portion 240 of the top edge 210 of the decorative sheet 114 is positioned on the top edge 126 of the first outer section 116 of the protective sheet 112, point B.

Figure 27:
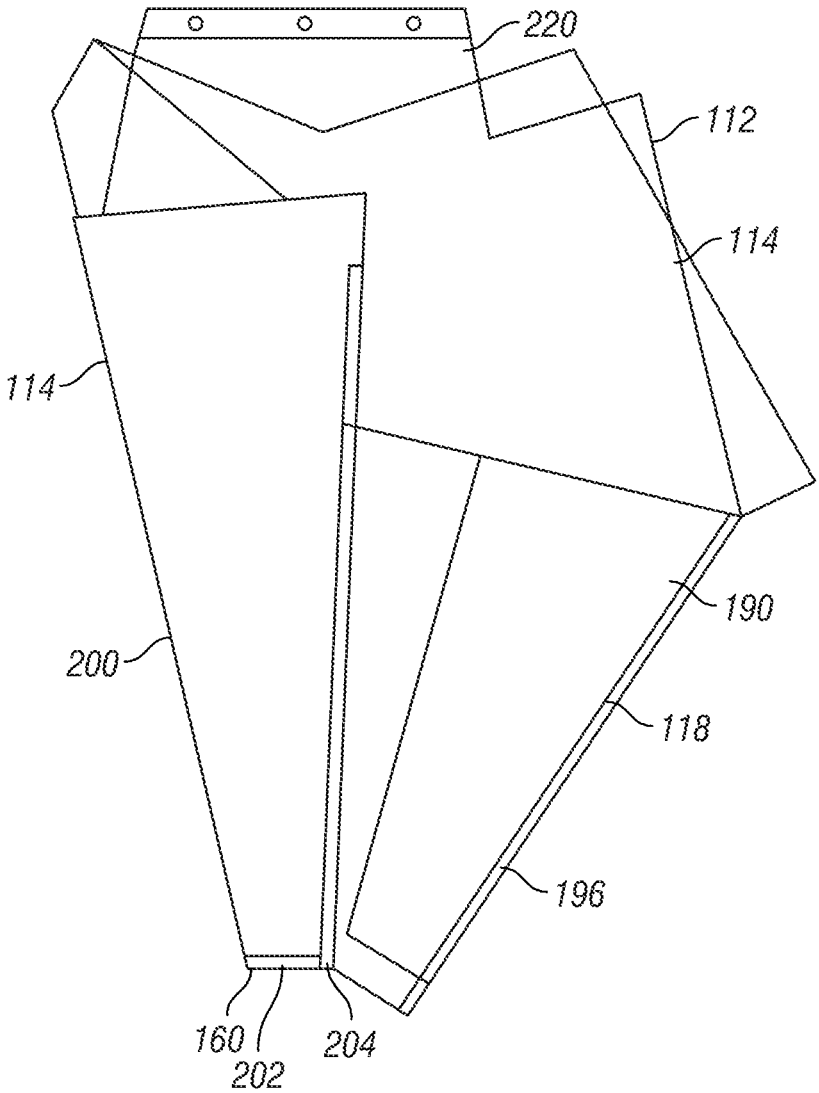
FIG. 27 depicts a partial closure of the alterative wrapping system of FIG. 26.
Figure 28:
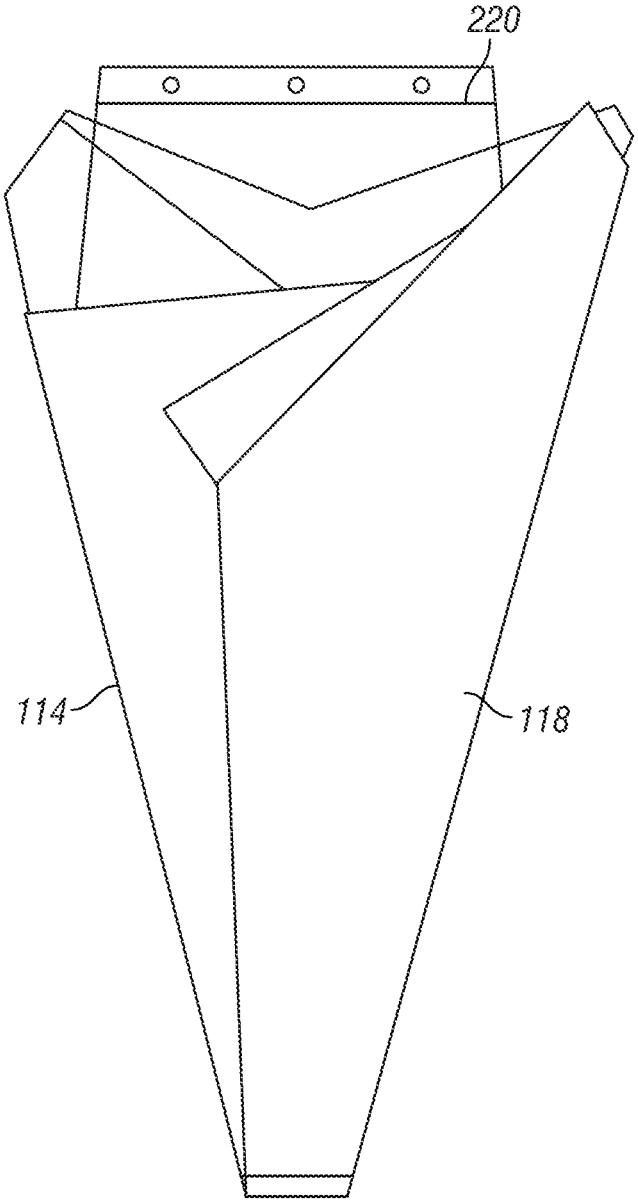
FIG. 28 depicts a full closure of the alterative wrapping system of FIG. 26.

Referring to FIGS. 27 and 28, to fold the wrapping system 110, the wrapping system 110 is placed on a flat surface, the inner surface 190 facing up. The first outer section 116 of the protective sheet 112 is folded over, along folding guide 122, on the center section 120 of the protected sheet 112. The bottom edge of the center section 160 is secured to the bottom edge 136 of the first outer section 116 using bonding element 198. Additionally, in this configuration, bonding elements 202 and 204 on the outer surface 200 of the first outer section 116 the protective sheet 112 are exposed.

The second outer section 118 of the protective sheet 112 is folded over, along the folding guide 124, onto the first outer section 116 of the protective sheet 112. The second outer section 118 is secured to the first outer section 116 with bonding elements 202 and 204 on the outer surface 200 of the first outer section 116 the protective sheet 112 and bonding element 196 on the inner surface 190 of the second outer section 118 of the protective sheet 112. The bottom of the wrapping system 110 is sealed by folding up the bottom edges 136, 152, and 160 of the protective sheet 112, along the bottom folding guides, and sealing with bonding element 206. In this manner, a pocket is formed within the wrapping system 110 to support plant/floral arrangements.

The protective sheet 112 can be made of a craft paper, where the craft paper can be non-laminated, laminated, or partially laminated. For example, where the inner surface 190 of the protective sheet 112 is laminated. The decorative sheet 114 can be made of a finewrap paper, where the finewrap paper can be of a unitary color and can also include a design element. As previously noted, materials other than craft paper and finewrap paper can be used.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A floral wrapper comprising:

a first sheet comprising a protective outer sheet with four sides, a corner of the first sheet being removed along a first line that forms a fifth side of the first sheet; and a second sheet comprising a decorative inner sheet with four sides, a corner of the second sheet being removed along a second line that forms a fifth side of the second sheet, wherein the first and second sheets are affixed to each other with the second sheet positioned on the first sheet such that the fifth side of the first sheet is aligned with a base plane and the fifth side of the second sheet is also aligned with the base plane, and a length of the fifth side of the first sheet is different than a length of the fifth side of the second sheet so that the second sheet only partially overlaps the first sheet.

2. The floral wrapper as set forth in claim 1, further comprising:

a third sheet comprising another decorative inner sheet with four sides, a corner of the third sheet being removed along a third line that forms a fifth side of the third sheet, wherein the third sheet is affixed to the first and second sheets with the third sheet positioned on the first sheet such that the fifth side of the third sheet is also aligned with the base plane, and the length of the fifth side of the first sheet is different than a length of the fifth side of the third sheet so that the third sheet only partially overlaps the first sheet.

3. The floral wrapper as set forth in claim 1, further comprising a raffia for securing the floral wrapper wrapped around a floral arrangement.

4. The floral wrapper as set forth in claim 2, wherein the first sheet is substantially square and each of the second and third sheets is substantially rectangular, and the first, second, and third sheets are affixed to each other with the first sheet between the second and third sheets and with the second sheet positioned on the first sheet and the third sheet positioned on the second sheet.

5. The floral wrapper as set forth in claim 4, wherein the second and third sheets are mirror images of each other.

6. The floral wrapper as set forth in claim 2, wherein none of the four sides of the second sheet lines up with any of the four sides of the first sheet, and none of the four sides of the third sheet lines up with any of the four sides of the first sheet.

7. The floral wrapper as set forth in claim 1, wherein the length of the fifth side of the first sheet is less than the length of the fifth side of the second sheet.

8. The floral wrapper as set forth in claim 1, wherein each corner of the first sheet is offset from a corresponding corner of the second sheet.

9. The floral wrapper as set forth in claim 1, wherein none of the four sides of the second sheet lines up with any of the four sides of the first sheet.

10. The floral wrapper as set forth in claim 1, wherein the first and second sheets each have a substantially rectangular or square shape.

11. The floral wrapper as set forth in claim 1, wherein the first sheet is substantially square and the second sheet is substantially rectangular.

12. A floral wrapper comprising:

a first sheet comprising a substantially square shape, a first corner of the first sheet being removed along a first line that forms a fifth side of the first sheet, opposite ends of the first line being a distance X1 from the first corner so that the fifth side of the first sheet is substantially perpendicular to a diagonal axis of the first sheet; and a second sheet comprising a substantially rectangular shape, a second corner of the second sheet being removed along a second line that forms a fifth side of the second sheet, one end of the second line being a distance Y1 from the second corner and the other end of the second line being a different distance Z1 from the second corner so that the fifth side of the second sheet is not substantially perpendicular to a diagonal axis of the second sheet, wherein the first and second sheets are affixed to each other with the second sheet positioned on the first sheet such that the fifth side of the first sheet is aligned with a base plane and the fifth side of the second sheet is also aligned with the base plane so that the second sheet only partially overlaps the first sheet.

13. The floral wrapper as set forth in claim 12, further comprising:

a third sheet comprising a substantially rectangular shape, a third corner of the third sheet being removed along a third line that forms a fifth side of the third sheet, one end of the third line being a distance Y2 from the third corner and the other end of the third line being a different distance Z2 from the third corner so that the fifth side of the third sheet is not substantially perpendicular to a diagonal axis of the third sheet, wherein the first and third sheets are affixed to each other with the third sheet positioned on the first sheet such that the fifth side of the third sheet is also aligned with the base plane so that the third sheet only partially overlaps the first sheet.

14. The floral wrapper as set forth in claim 13, wherein Y1=Y2 and Z1=Z2 such that the second and third sheets are mirror images of each other.

15. The floral wrapper as set forth in claim 14, wherein the second sheet has two opposing sides each with a length Y and two other opposing sides each with a length Z, wherein the third sheet has two opposing sides each with a length Y and two other opposing sides each with a length Z, and Y-Y1 is substantially equal to Z.

16. The floral wrapper as set forth in claim 13, wherein only the fifth side of the second sheet lines up with any of the sides of the first sheet, and only the fifth side of the third sheet lines up with any of the sides of the first sheet.

17. The floral wrapper as set forth in claim 12, wherein the second sheet has two opposing sides each with a length Y and two other opposing sides each with a length Z, and Y-Y1 is substantially equal to Z.

18. The floral wrapper as set forth in claim 12, wherein a length of the fifth side of the first sheet is less than a length of the fifth side of the second sheet.

19. The floral wrapper as set forth in claim 12, wherein each corner of the first sheet is offset from a corresponding corner of the second sheet.

20. The floral wrapper as set forth in claim 12, wherein only the fifth side of the second sheet lines up with any of the sides of the first sheet.

* * * * *